US009706861B2

(12) United States Patent
Wong

(10) Patent No.: US 9,706,861 B2
(45) **Date of Patent: *Jul. 18, 2017**

(54) PRINTED SHEET WITH FOLDABLE FRAME, BLANK AND METHOD FOR PRODUCING THE SAME

(71) Applicant: Kwok Hee Wong, Hong Kong (HK)

(72) Inventor: Kwok Hee Wong, Hong Kong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/278,081

(22) Filed: Sep. 28, 2016

(65) Prior Publication Data

US 2017/0013976 A1 Jan. 19, 2017

Related U.S. Application Data

(63) Continuation-in-part of application No. 15/011,692, filed on Feb. 1, 2016, now Pat. No. 9,486,093.

(60) Provisional application No. 62/114,083, filed on Feb. 10, 2015.

(51) Int. Cl.
*A47G 1/06* (2006.01)
*B31D 5/04* (2017.01)

(52) U.S. Cl.
CPC ..... *A47G 1/0633* (2013.01); *B31D 5/04* (2013.01)

(58) Field of Classification Search
CPC ..... A47G 1/0633
USPC ..... 40/786, 788
See application file for complete search history.

(56) References Cited

U.S. PATENT DOCUMENTS 1,331,009 A * 2/1920 Ford ..... A47G 1/0633 229/168
1,513,050 A * 10/1924 Kristofek ..... A47G 1/0633 40/757
1,528,361 A * 3/1925 Bashwiner ..... G09F 1/06 40/788
3,286,387 A * 11/1966 Poertner ..... A47G 1/0633 40/788
4,870,766 A * 10/1989 Topping ..... G09F 1/12 40/788
5,359,794 A * 11/1994 Wood ..... G09F 1/12 40/789
2013/0227868 A1 9/2013 Edmondson et al.

FOREIGN PATENT DOCUMENTS

CN 1044212 A 8/1990
CN 202151258 U 2/2012
WO WO 2013119249 A1 * 8/2013 ..... A47G 1/0633

OTHER PUBLICATIONS

International Search Report of PCT Patent Application No. PCT/CN2016/080279 issued on Jan. 25, 2017.

* cited by examiner

*Primary Examiner* — Joanne Silbermann

(57) ABSTRACT

A blank for forming a printed sheet with foldable frame includes a blank body having front and rear surfaces, a central rectangular portion formed thereon with a print on the front surface. The blank further includes four wing portions extending from the four margins of the central rectangular portion and the four wing portions are foldable into four rectangular tubular frame sections. Twelve locking mechanisms are used to lock the four frame sections in a folded position. A method of forming the printed sheet with foldable frame is also disclosed.

20 Claims, 23 Drawing Sheets

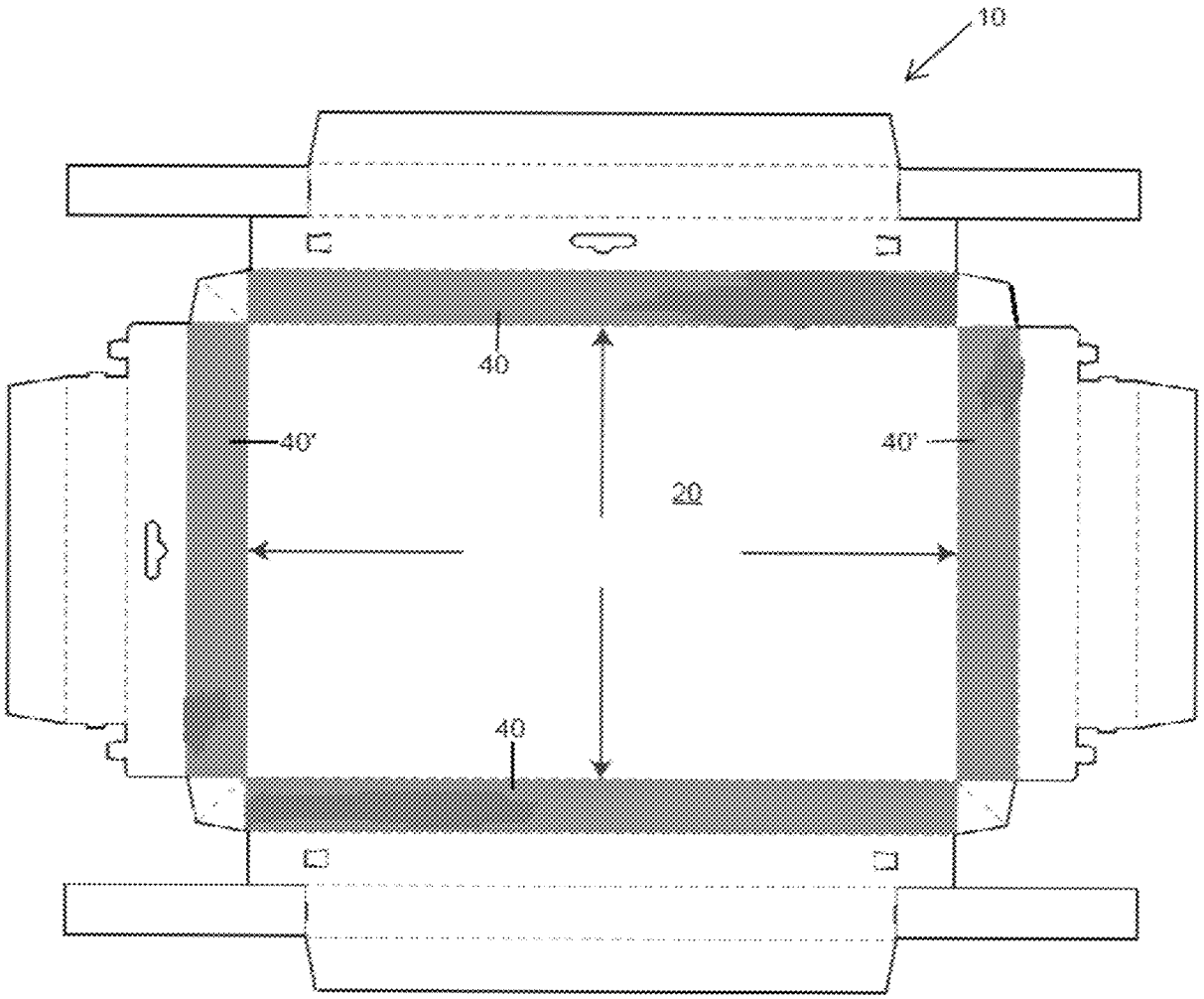
Fig. 1.1

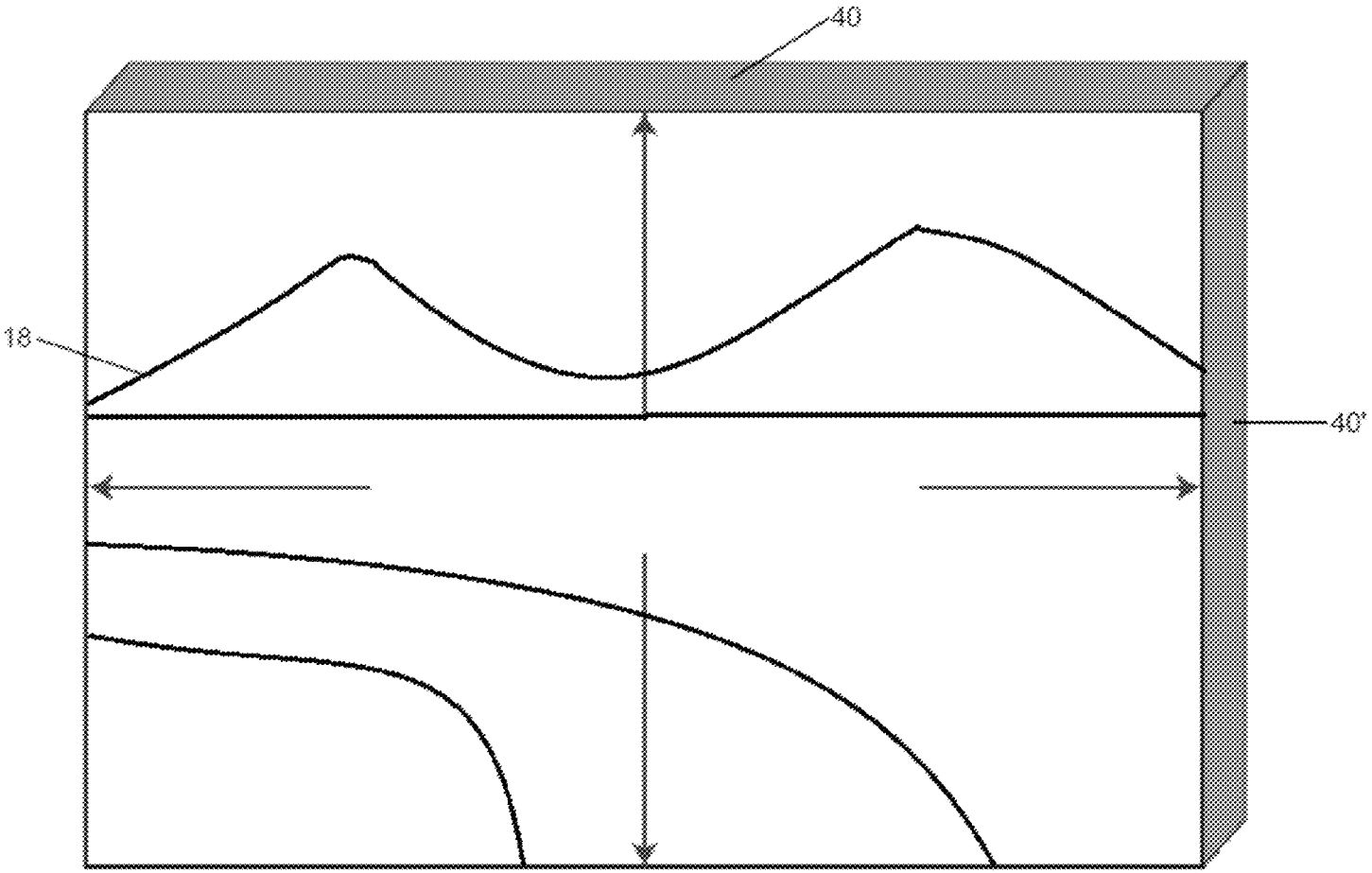
Fig. 1.1.1

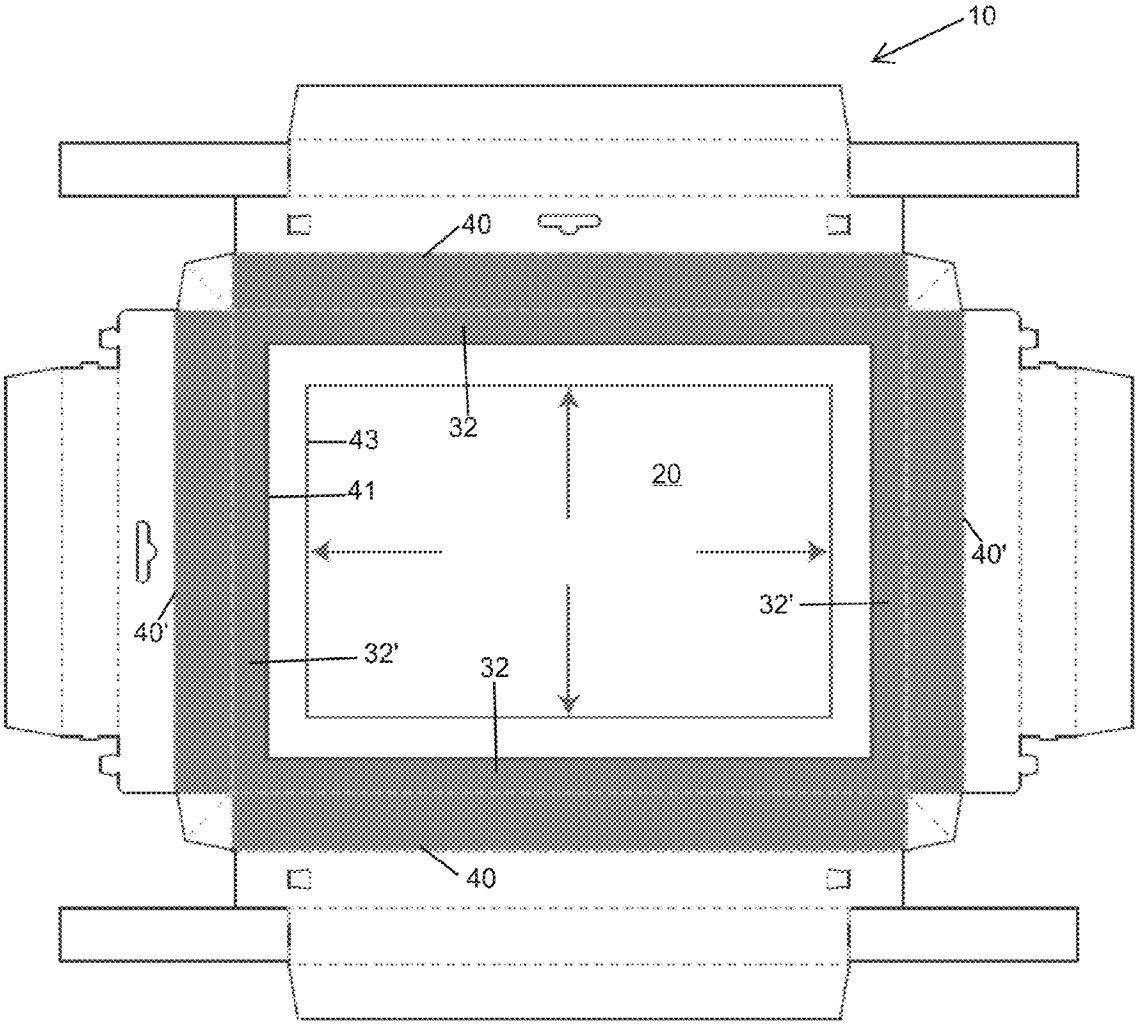
Fig. 1.2

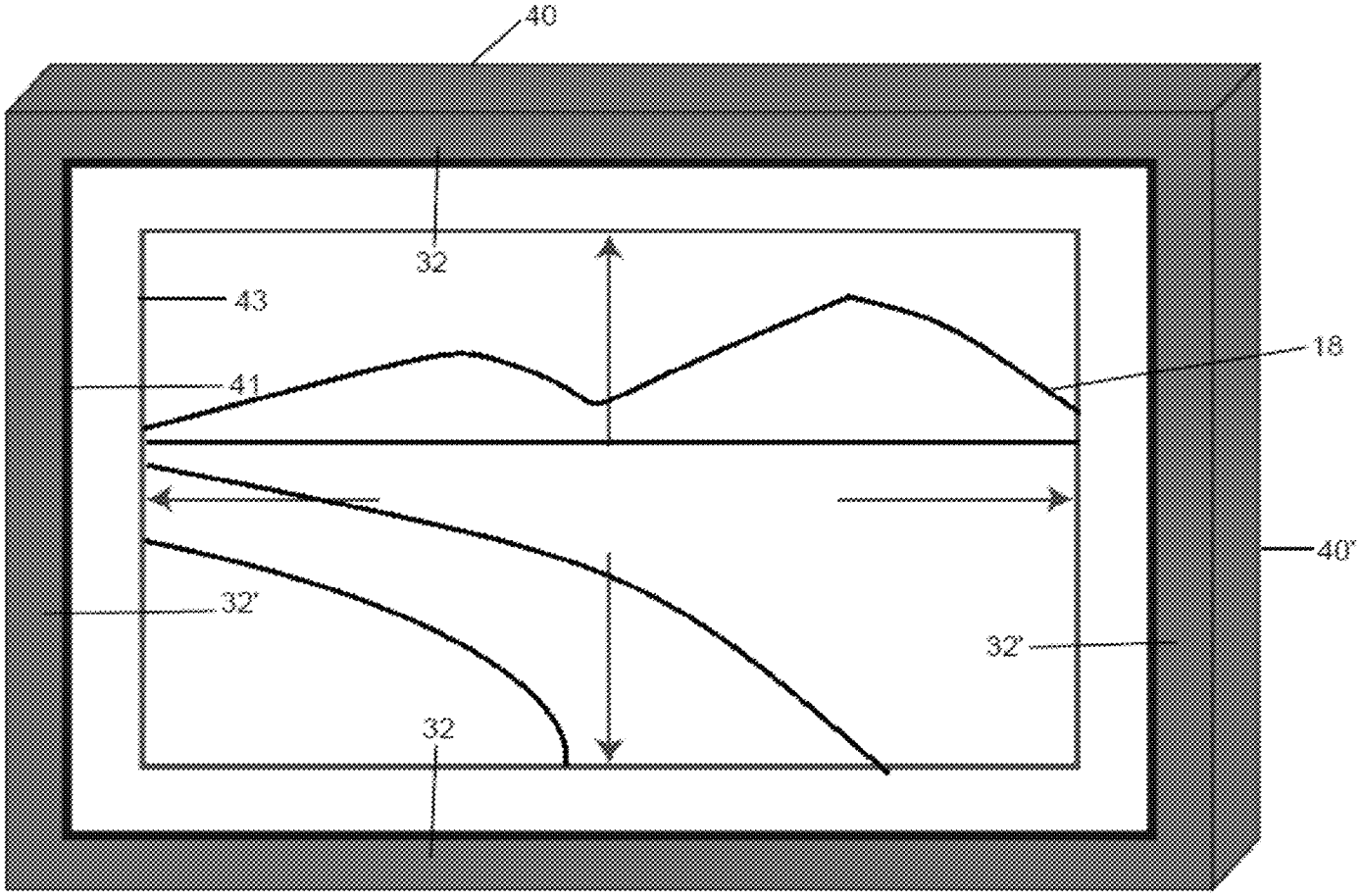
Fig. 1.2.1

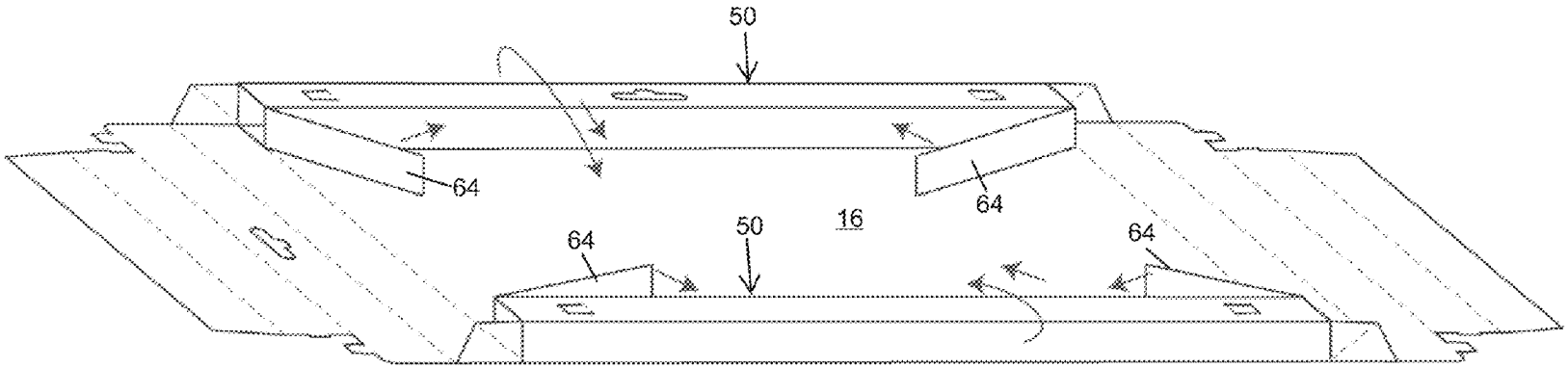
Fig. 2.1 A
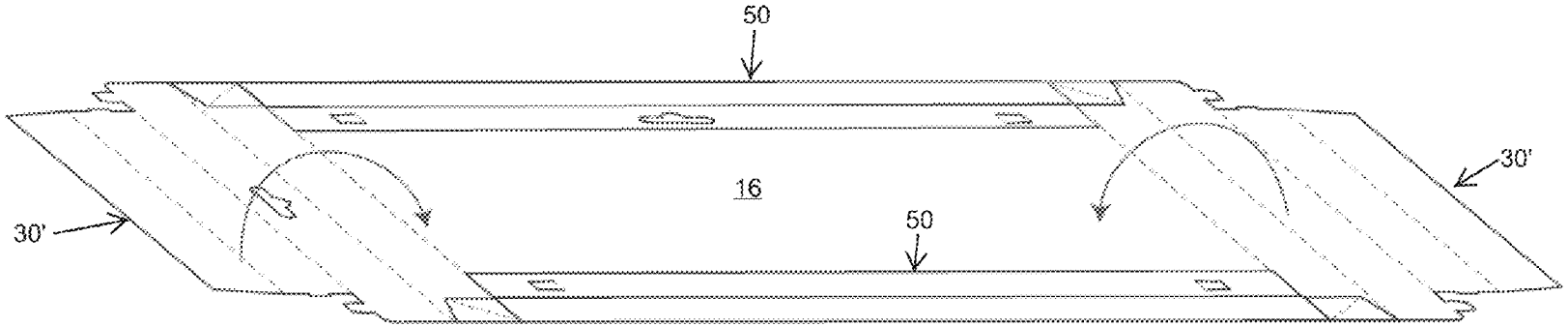
Fig. 2.1 B

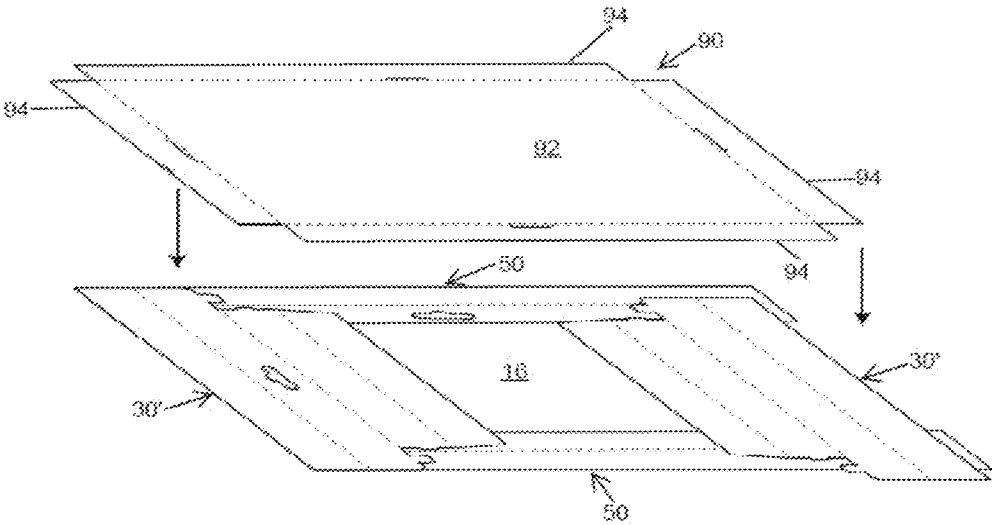
Fig. 2.2A
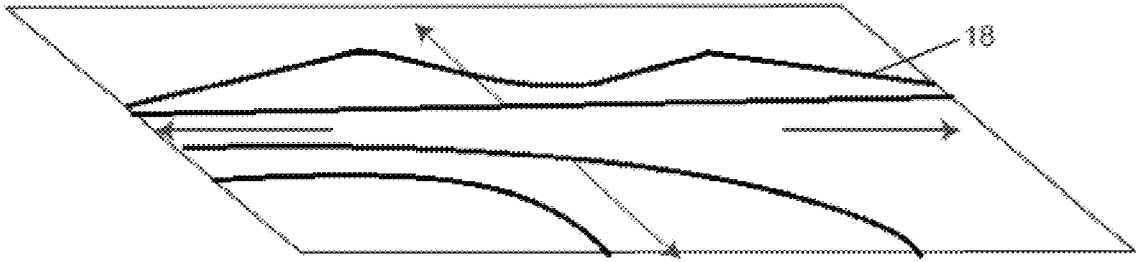
Fig. 2.2B

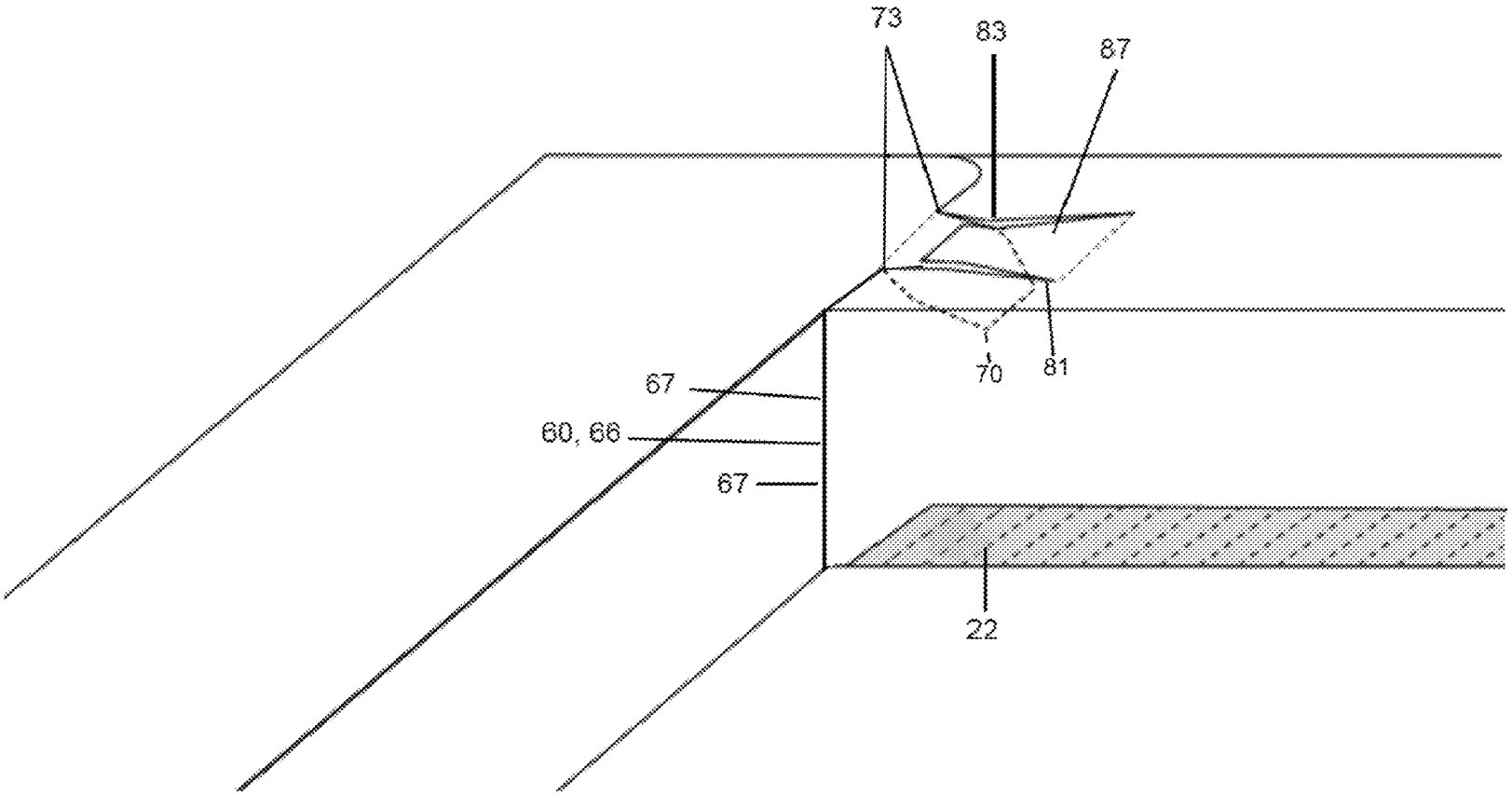
Fig. 4.1

Fig. 5.1

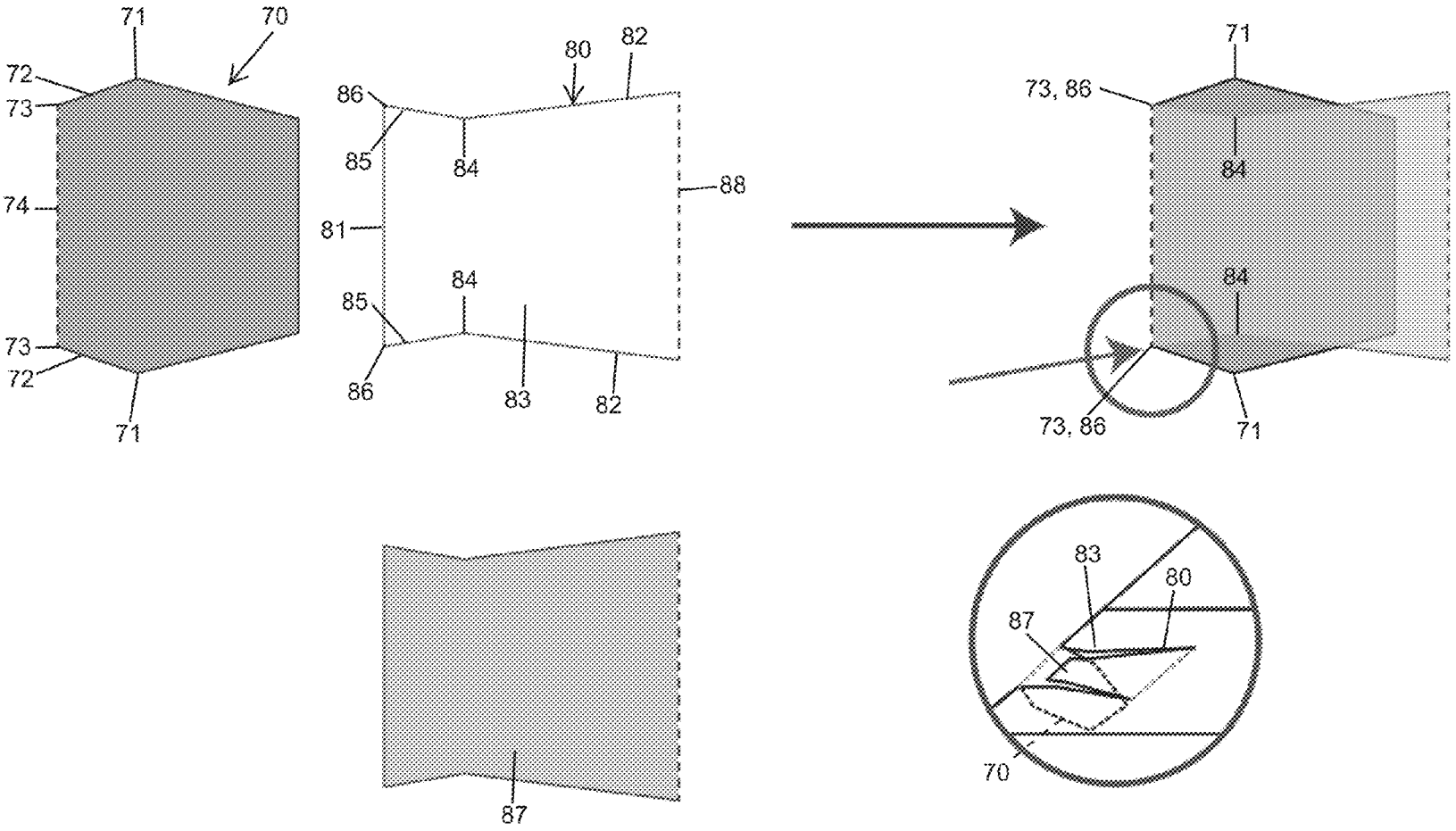
Fig. 6.1

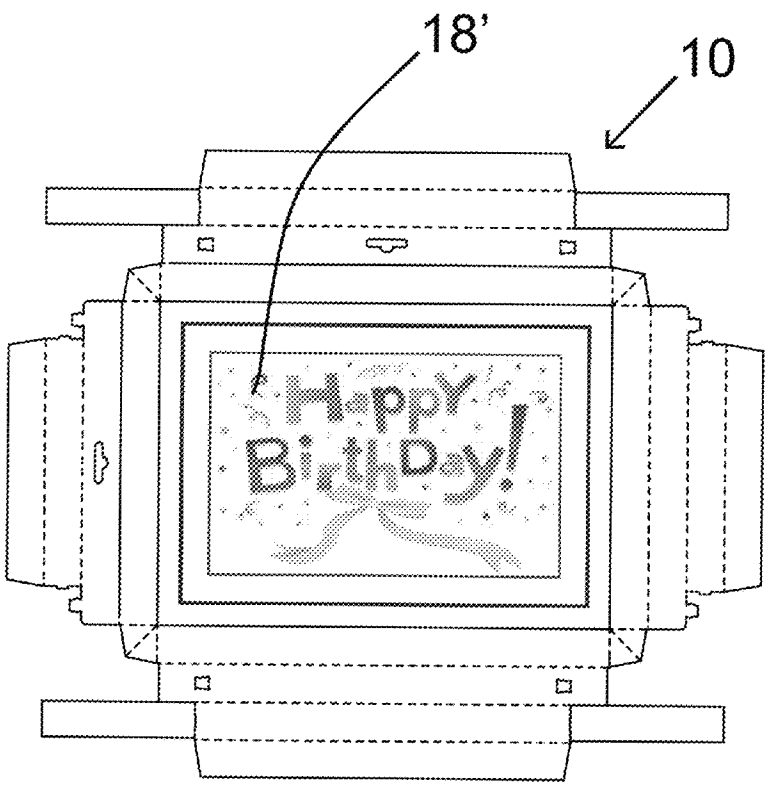
Fig. 8.2
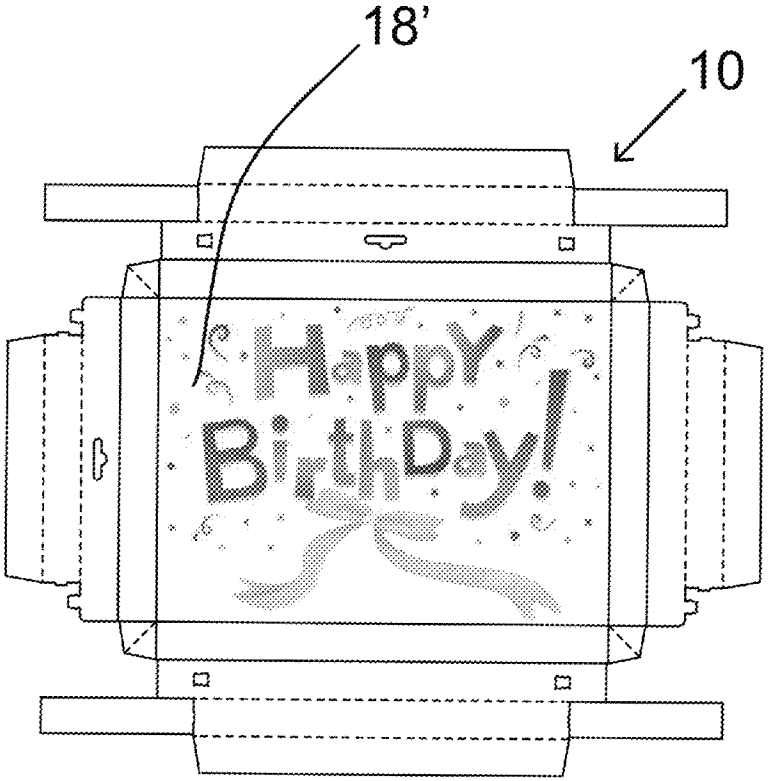
Fig. 8.1

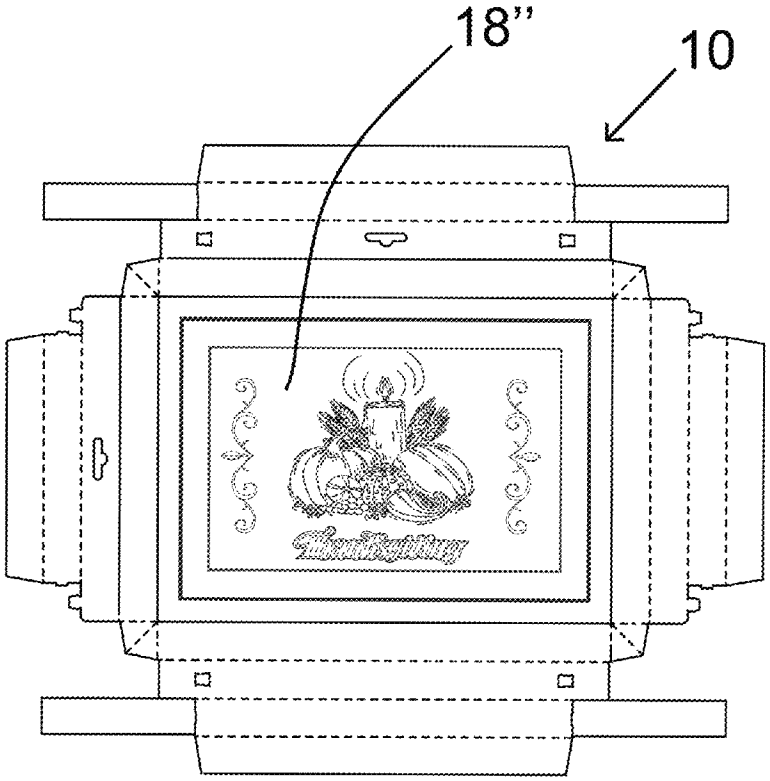
Fig. 8.4
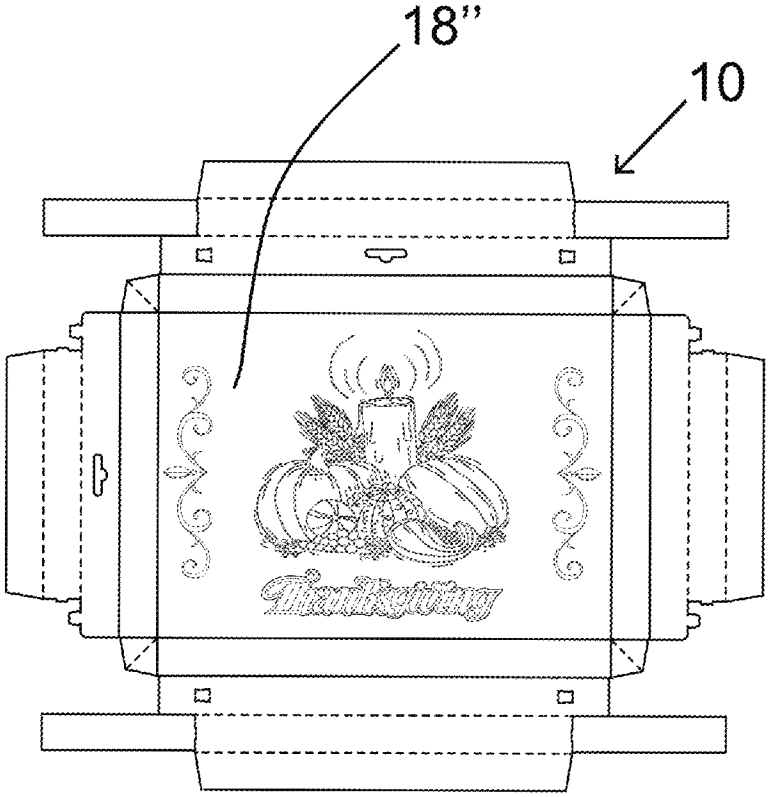
Fig. 8.3

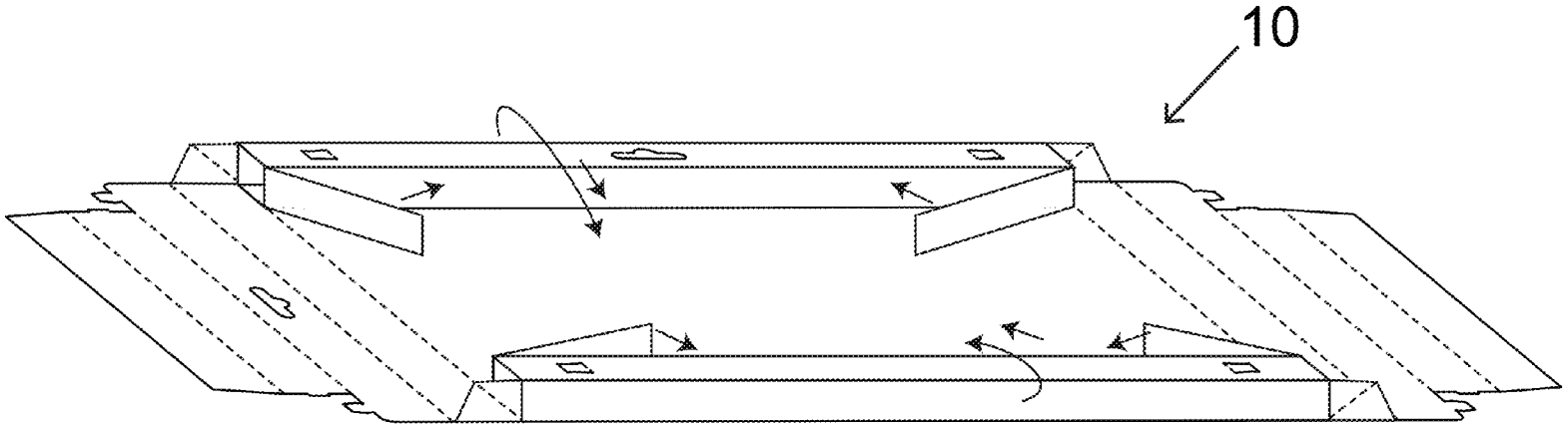
Fig. 9.1
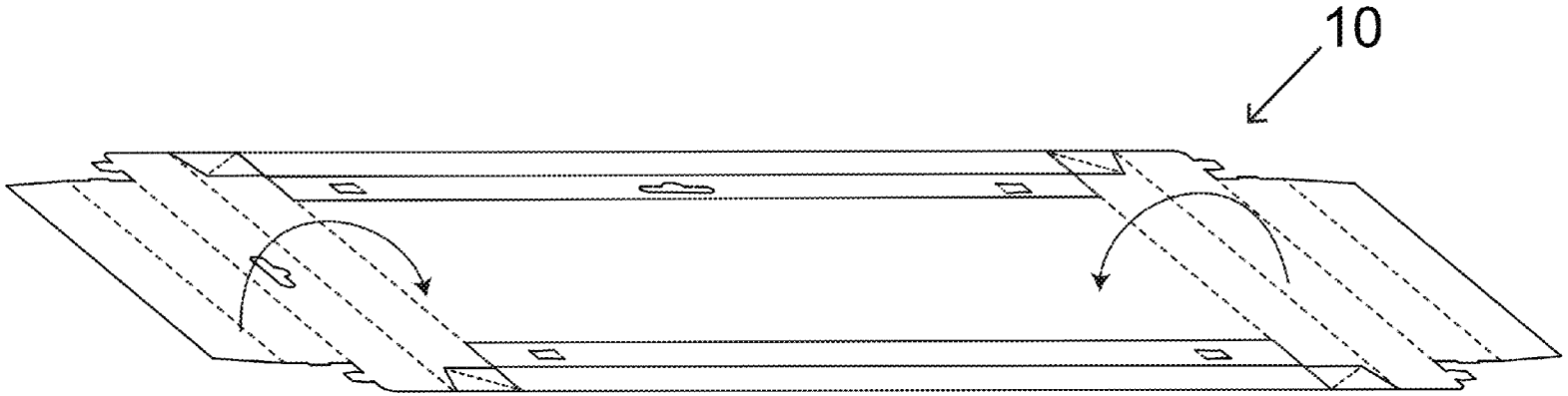
Fig. 9.2

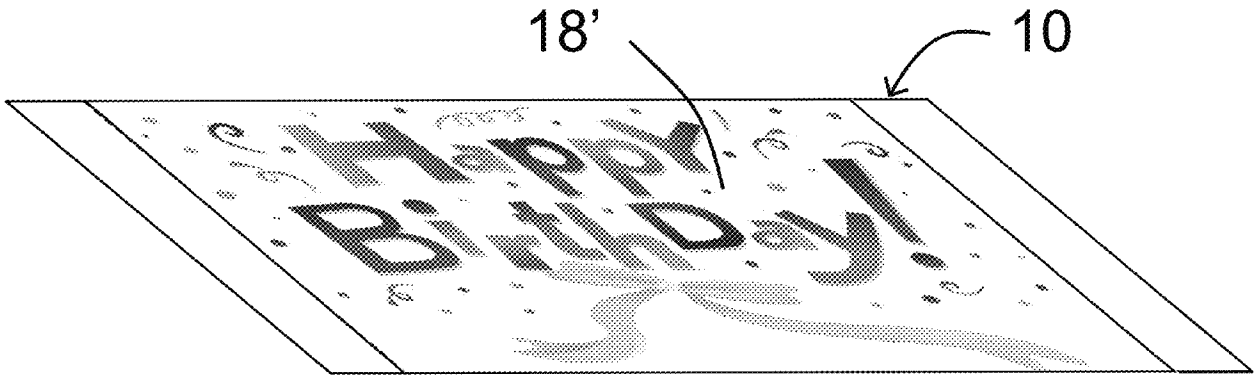
Fig. 11.1
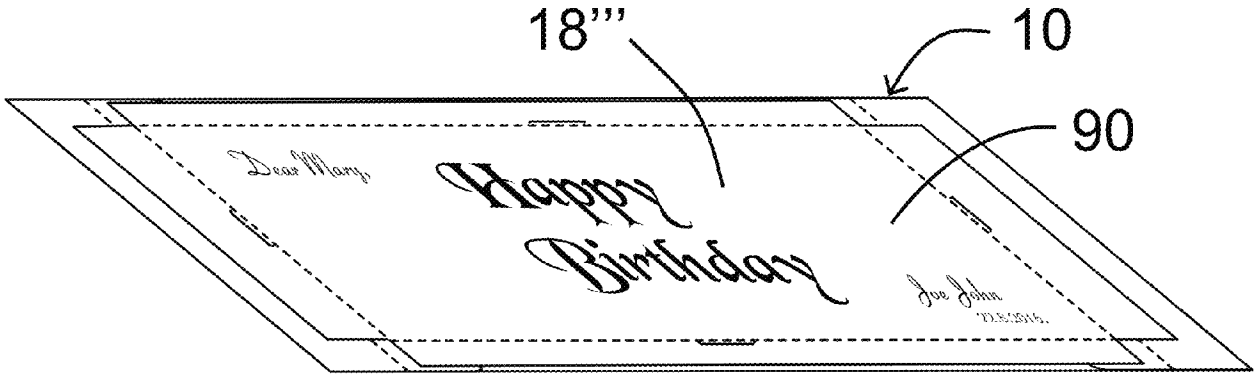
Fig. 11.2

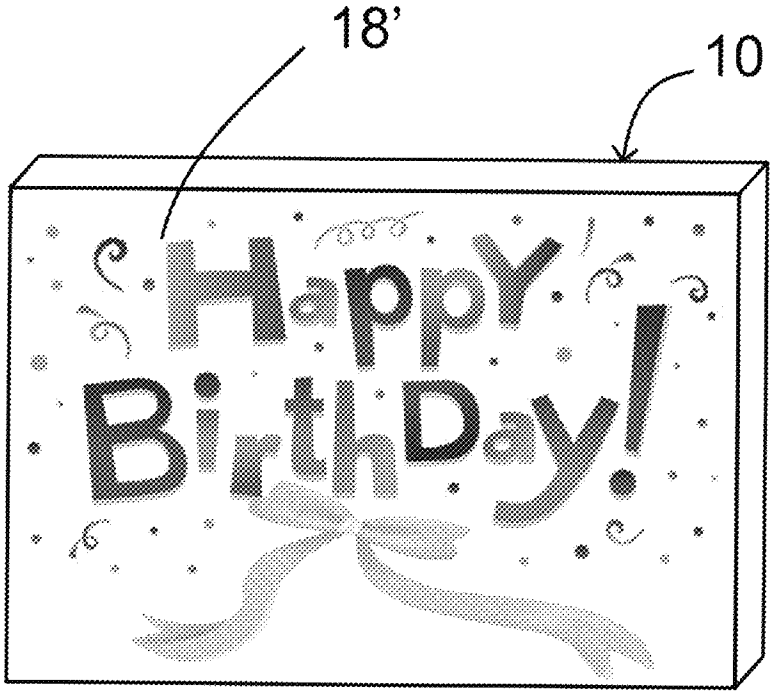
Fig. 12.1
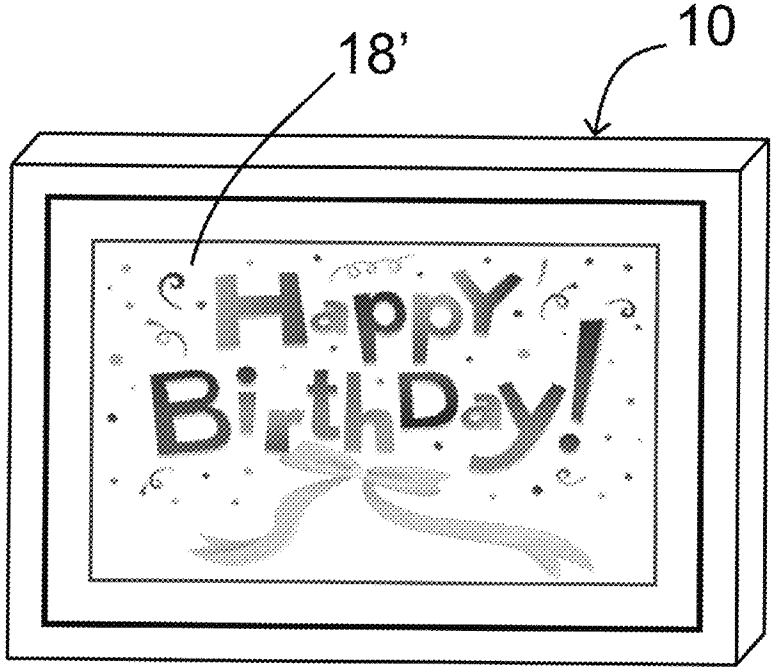
Fig. 12.2

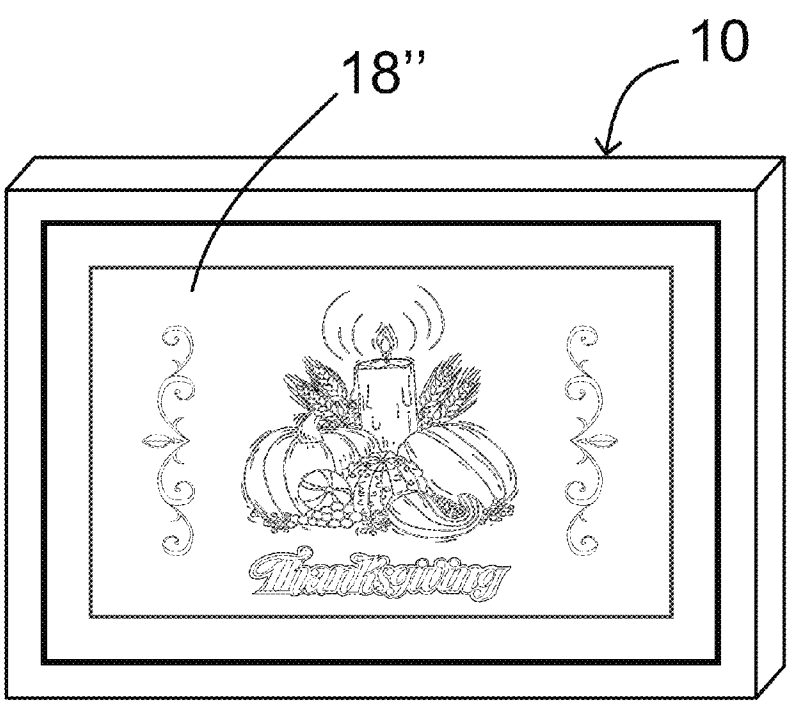
Fig. 12.4
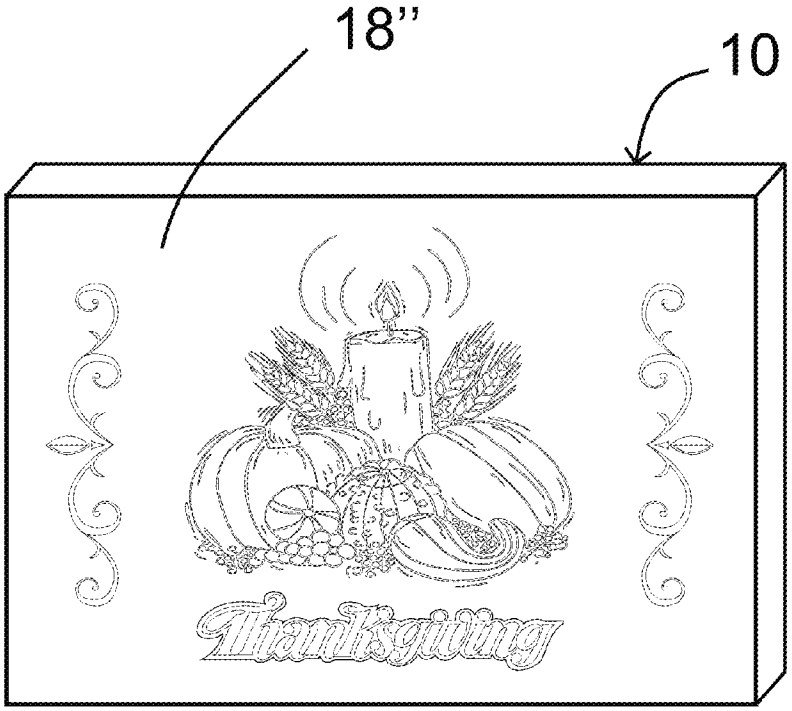
Fig. 12.3

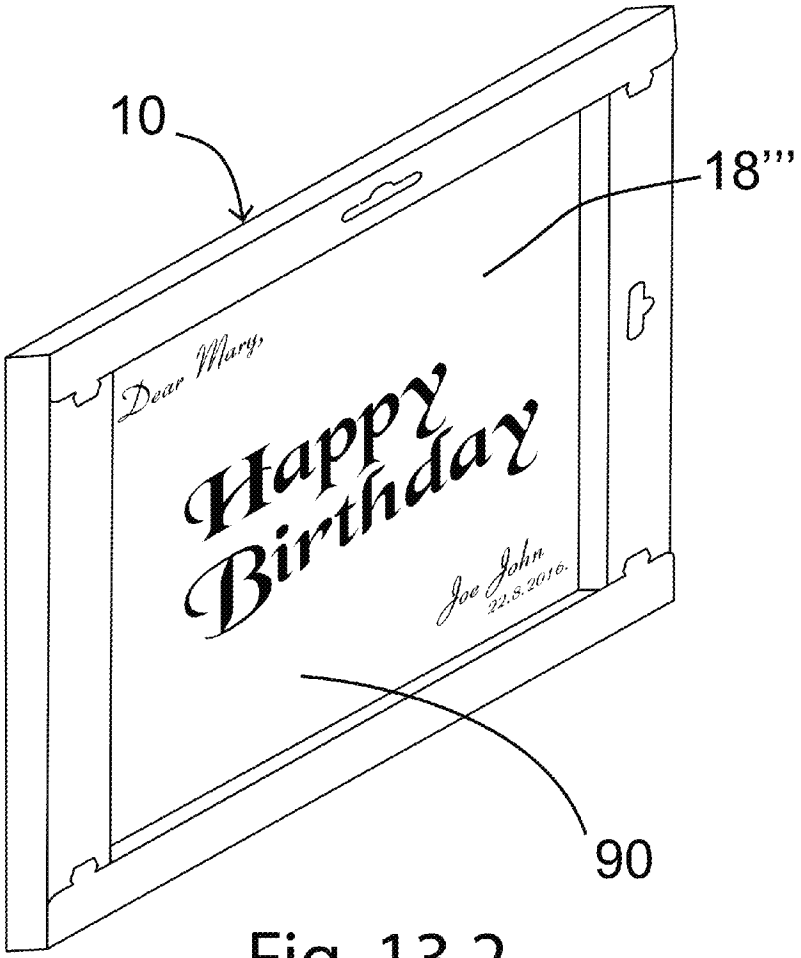
Fig. 13.2
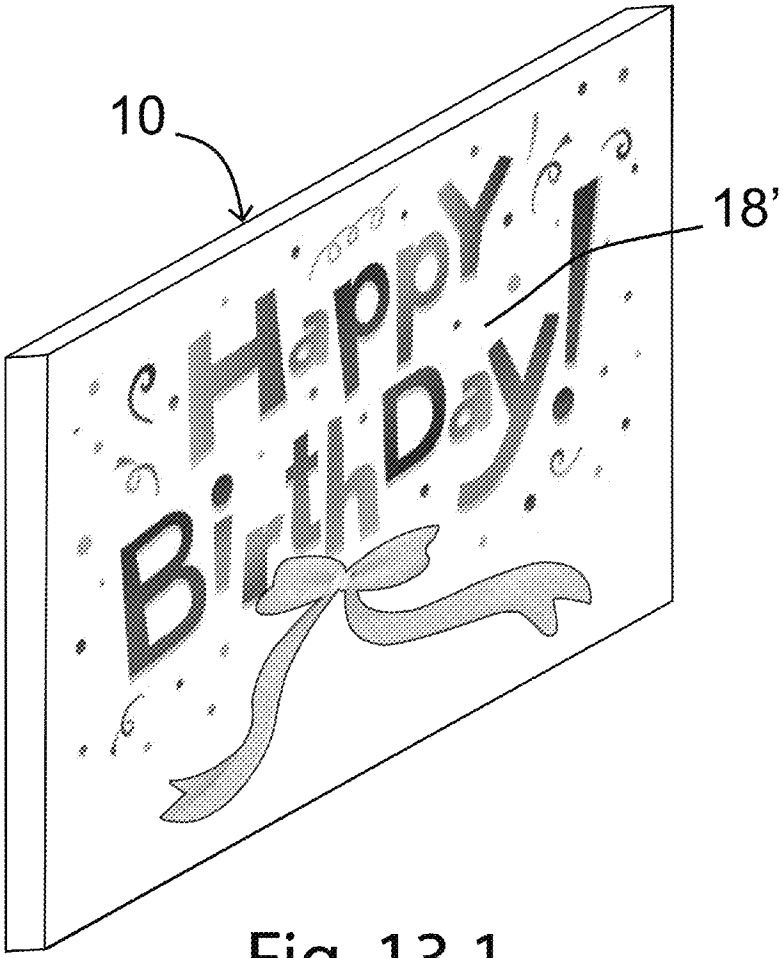
Fig. 13.1

PRINTED SHEET WITH FOLDABLE FRAME, BLANK AND METHOD FOR PRODUCING THE SAME

CROSS-REFERENCE TO RELATED APPLICATIONS

This application is a continuation-in-part of U.S. patent application Ser. No. 15/011,692 filed Feb. 1, 2016, which claims the benefit of U.S. Provisional Patent Application No. 62/114,083 filed Feb. 10, 2015, the entire contents of all of which are hereby incorporated by reference.

FIELD OF THE TECHNOLOGY

The present application relates to a printed card or sheet (e.g. greeting card, coloring sheet, picture, etc.) with foldable frame, and a blank and a method for producing the same.

BACKGROUND

In an ordinary picture frame with picture/picture, the photo/picture is separated from the photo frame. Ordinary photo/picture for decoration is printed out by digital printing, offset printing or inkjet printing, and the photo frame is usually made of wood or other plastic material. After the photo/picture and the photo frame are produced separately, the photo/picture needs to be manually mounted on the photo frame to produce the final product. This results in high cost and complicated production process. An ordinary photo frame usually comes with a piece of glass or a layer of transparent membrane to cover the photo/frame. This makes the entire photo frame product very heavy. One needs to drill a hole on a wall and install a hook in the hole in order to securely hang the photo frame. Also, heavy photo frame leads to high transportation fees as well as difficulties in packaging and transporting. Hence, there is a need to produce an improved foldable frame with picture and a printed card or sheet with foldable frame.

SUMMARY

According to one aspect, there is provided a blank of foldable sheet material for forming a printed sheet with foldable frame. The blank may include:

a blank body having a front surface and a rear surface;

a central rectangular portion provided at a central portion of the blank body and adapted to form thereon on the front surface thereof a print;

two opposite first wing portions extending from two opposite first margins of the central rectangular portion respectively; and two opposite second wing portions extending from two opposite second margins of the central rectangular portion respectively;

wherein each of the first and second wing portions may include four parallel fold lines parallel with respect to the margin from which the wing portion extends, and defines an elongate frame-simulation panel, a first elongate lock panel, a second elongate lock panel and an elongate end panel in an order from the margin; each elongate frame-simulation panel being printed thereon with a frame-simulating printing simulating a frame surface of a conventional photo frame; and wherein the four wing portions can be foldable rearwards about the fold lines to a folded position where the four end panels rest on the four margins of the central rectangular portion at the rear surface thereof respectively, thereby forming four rectangular tubular frame sections extending along the four margins of the central rectangular portion at the rear surface thereof.

The blank may further include:

an elongate panel extension extending from each opposite end of each second elongate lock panels of the two opposite first wing portions, and flippable about a transverse fold line formed between the elongate panel extension and the opposite end of the second elongate lock panel of the two opposite first wing portions;

a slit formed along each transverse fold line at a middle portion thereof; and a tab formed at each opposite end of each second elongate lock panel of the two opposite second wing portions;

wherein after the two opposite first wing portions are folded into the folded position, the four elongate panel extensions are flippable 90 degrees about the transverse fold lines towards the two opposite second margins such that the elongate panel extensions are held within the two tubular frame sections formed after the two opposite second wing portions are folded into the folded position, and wherein the four tabs can be inserted into and engaged with the four slits respectively at four corners of the folded frame, thereby locking the four tubular frame sections in the folded position.

The blank may further include:

a flap formed on a side edge of each opposite end portion of each first elongate lock panel of the two opposite second wing portions, and the side edge being contiguous with and perpendicular to the opposite end of the second elongate lock panel of the two opposite second wing portions on which the tab is formed; and a shaped slit formed on each opposite end portion of each first elongate lock panel of the two opposite first wing portions, each shaped slit including a transverse slit and two longitudinal slits extending from two opposite ends of the transverse slit respectively towards a central portion of the first elongate lock panel, and each shaped slit defining a temporarily covered aperture and a cover;

wherein the four flaps may be disposed over the four temporarily covered apertures respectively after the four wing portions are folded into the folded position, and the four flaps can be flippable through the temporarily covered apertures and engageable with the four apertures respectively, thereby locking the four rectangular tubular frame sections in the folded position.

In one embodiment, each flap may have two opposite sides formed with two protruding portions respectively and defining two opposite undercuts with two locking points disposed at two opposite ends of a base of the flap respectively, and each aperture may have two opposite sides formed with two oppositely facing protruding portions respectively, and defining two corresponding opposite undercuts with two corresponding locking points disposed at two opposite ends of the transverse slit; and wherein the flap at the two protruding portions may have a width longer than that of the aperture at the two oppositely facing protruding portions, whereby when the flap is flipped through the temporarily closed aperture, the two protruding portions of the flap can be retainable under the two oppositely facing protruding portions of the aperture respectively, and the two opposite locking points of two opposite undercuts of the flap can be engageable with the two corresponding locking points of the two corresponding opposite undercuts of the aperture respectively, thereby locking the four tubular frame sections in the folded position.

In one embodiment, the four margins of the central rectangular portion at the front surface thereof are further printed thereon with the frame-simulating printing simulating the frame surface of the conventional photo frame, and the print may be printed on the front surface within the four margins.

The blank may further include a first rectangular border line printed on the front surface along a rectangular inner boundary of the four margins, and a second rectangular border line printed on the front surface along a rectangular outer periphery of the print and spaced inwardly apart from the first rectangular border line to thereby simulate the conventional photo frame.

The blank may further include a corner panel formed at each corner of the central rectangular portion between adjacent ends of the elongate frame-simulation panels of the four wing portions, each corner panel being formed with a diagonal fold line whereby each corner panel can be foldable inwards about the diagonal fold line when the four wing portions are folded into the folded position.

In one embodiment, the two elongate end panels of the two opposite first wing portions may be adhered to the rear surface of the central rectangular portion at the first margin thereof by glue or adhesive tapes.

In one embodiment, a first opening may be formed on one of the two first elongate lock panels of the two opposite first wing portions, and a second opening may be formed on one of the two first elongate lock panels of the two opposite second wing portions to facilitate hanging of the folded frame on a wall.

In one embodiment, the blank body may be made of paperboard.

In one embodiment, the print may include a greeting message of a greeting card.

In one embodiment, the print may include an illustration outline of a coloring sheet.

According to another aspect, there is provided a printed sheet with foldable frame formed from a blank of foldable sheet material as mentioned above. The printed sheet with foldable frame may further include a separate backing card having a rectangular panel, and four side panels formed along four side edges of the rectangular panel respectively such that after the four side panels are folded 90 degrees towards one side of the rectangular panel about four backing card fold lines formed along the four side edges of the rectangular panel respectively, the folded backing card is insertable into a rectangular space defined by the four rectangular tubular frame sections in the folded position such that the rectangular panel rests on the rear surface of the central rectangular portion and the four side panels snugly abut against the second elongate lock panels of the four rectangular tubular frame sections respectively.

The printed sheet with foldable frame may further include four square bracket-shaped slits each having a shape of a square bracket "[" formed on each backing card fold line, and when the backing card fold line is folded, a slot and a projection having a shape of a square bracket "[" are formed. A corresponding square bracket-shaped slit may be further formed on each fold line between the second elongate lock panel and the elongate end panel of each of the four wing portions, and when the fold line is folded, a slot and a projection having a shape of a square bracket "[" are formed. The four projections formed on the backing card can be insertable into the four corresponding slots formed on the four rectangular tubular frame sections after the four wing portions are folded into the folded position, thereby locking the four rectangular tubular frame sections in the folded position.

In one embodiment, a greeting message may be printed or written on an outwardly facing surface of the backing card.

According to a further aspect, there is provided a method for producing a printed sheet with foldable frame from a blank of foldable sheet material. The method may include:

forming a blank including:

a blank body having a front surface and a rear surface;

a central rectangular portion provided at a central portion of the blank body and adapted to form thereon on the front surface thereof a print;

two opposite first wing portions extending from two opposite first margins of the central rectangular portion respectively; and two opposite second wing portions extending from two opposite second margins of the central rectangular portion respectively;

wherein each of the first and second wing portions may include four parallel fold lines parallel with respect to the margin from which the wing portion extends, and defining an elongate frame-simulation panel, a first elongate lock panel, a second elongate lock panel and an elongate end panel in an order from the margin; each frame-simulation panel being printed thereon with a frame-simulating printing simulating a frame surface of a conventional photo frame; and folding the four wing portions rearwards about the fold lines to a folded position where the four end panels rest on the four margins of the central rectangular portion at the rear surface thereof respectively, thereby forming four rectangular tubular frame sections extending along the four margins of the central rectangular portion at the rear surface thereof.

The method may further include printing the print on the front surface of the blank body at the central rectangular portion thereof at the same time of printing the frame-simulating printing.

The method may further include:

forming, at the same time of forming the blank, an elongate panel extension extending from each opposite end of each second elongate lock panels of the two opposite first wing portions, and flippable about a transverse fold line formed between the elongate panel extension and the opposite end of the second elongate lock panel of the two opposite first wing portions;

a slit formed along each transverse fold line at a middle portion thereof; and a tab formed at each opposite end of each second elongate lock panel of the two opposite second wing portions; and flipping the four elongate panel extensions 90 degrees about the transverse fold lines towards the two opposite second margins after the two opposite first wing portions are folded into the folded position, such that the elongate panel extensions can be held within the two tubular frame sections formed after the two opposite second wing portions are folded into the folded position, and wherein the four tabs can be inserted into and engaged with the four slits respectively at four corners of the folded frame, thereby locking the four tubular frame sections in the folded position.

The method may further include:

forming, at the same time of forming the blank, a flap on a side edge of each opposite end portion of each first elongate lock panel of the two opposite second wing portions, and the side edge being contiguous with and perpendicular to the opposite end of the second elongate lock panel of the two opposite second wing portions on which the tab is formed; and a shaped slit each being formed on each opposite end portion of each first elongate lock panel of the two opposite first wing portions, each shaped slit may include a transverse slit and two longitudinal slits extending from two opposite ends of the transverse slit respectively towards a central portion of the first elongate lock panel, and each shaped slit defining a temporarily covered aperture and a cover, wherein the four flaps may be disposed over the four temporarily covered apertures respectively after the four wing portions are folded into the folded position; and flipping the four flaps through the temporarily covered apertures such that the four flaps can be engageable with the four apertures respectively, thereby locking the four rectangular tubular frame sections in the folded position.

The method may further include printing on the four margins of the central rectangular portion at the front surface thereof with the frame-simulating printing simulating the frame surface of the conventional photo frame at the same time of printing the print, and the print may be printed on the front surface within the four margins.

The method may further include printing, at the same time of printing the frame-simulating printing, a first rectangular border line on the front surface along a rectangular inner boundary of the four margins, and a second rectangular border line on the front surface along a rectangular outer periphery of the print and spaced inwardly apart from the first rectangular border line to thereby simulate the conventional photo frame.

Although the printed sheet with foldable frame is shown and described with respect to certain embodiments, it is obvious that equivalents and modifications will occur to others skilled in the art upon the reading and understanding of the specification. The printed sheet with foldable frame in the present application includes all such equivalents and modifications, and is limited only by the scope of the claims.

BRIEF DESCRIPTION OF THE DRAWINGS

Specific embodiments of the printed sheet with foldable frame will now be described by way of example with reference to the accompanying drawings wherein:

FIG. 1.1 is a blank of foldable sheet material for forming into a first embodiment of a picture frame with picture.

FIG. 1.1.1 is a folded picture frame with picture formed from the blank shown in FIG. 1.1.

FIG. 1.2 is a blank of foldable sheet material for forming into a second embodiment of a picture frame with picture.

FIG. 1.2.1 is a folded picture frame with picture formed from the blank shown in FIG. 1.2.

FIG. 2.1A-B shows the folding the picture frame into a flat form for packaging.

FIG. 2.2A-B shows the folded picture frame of FIG. 2.1 and a backing card.

FIG. 4.1 is an enlarged view of the locking mechanisms 1 and 5 of the picture frame.

FIG. 5.1 is an enlarged view of the locking mechanisms 9-12 of the backing card.

FIG. 6.1 shows the detailed structure of the locking mechanisms 5-8.

FIG. 8.1 is a blank of foldable sheet material for forming into a first embodiment of a greeting card with foldable frame.

FIG. 8.2 is a blank of foldable sheet material for forming into a second embodiment of a greeting card with foldable frame.

FIG. 8.3 is a blank of foldable sheet material for forming into a first embodiment of a coloring sheet with foldable frame.

FIG. 8.4 is a blank of foldable sheet material for forming into a second embodiment of a coloring sheet with foldable frame.

FIGS. 9.1 and 9.2 show the steps of folding the foldable frame into a flat form.

FIGS. 11.1 and 11.2 show front and rear perspective views respectively of a finished product in a flat form for delivery.

FIG. 12.1 is a front perspective view of a greeting card with folded frame formed from the blank shown in FIG. 8.1.

FIG. 12.2 is a front perspective view of a greeting card with folded frame formed from the blank shown in FIG. 8.2.

FIG. 12.3 is a front perspective view of a coloring sheet with folded frame formed from the blank shown in FIG. 8.3.

FIG. 12.4 is a front perspective view of a coloring sheet with folded frame formed from the blank shown in FIG. 8.4.

FIGS. 13.1 and 13.2 are front and rear perspective views respectively of the foldable frame with greeting message printed on the front and greeting description printed or written on the backing card.

DETAILED DESCRIPTION

Reference will now be made in detail to a preferred embodiment of the printed sheet with foldable frame, examples of which are also provided in the following description. Exemplary embodiments of the printed sheet with foldable frame are described in detail, although it will be apparent to those skilled in the relevant art that some features that are not particularly important to an understanding of the printed sheet with foldable frame may not be shown for the sake of clarity.

Furthermore, it should be understood that the printed sheet with foldable frame is not limited to the precise embodiments described below and that various changes and modifications thereof may be effected by one skilled in the art without departing from the scope of the protection. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the scope of the protection.

Figure 1:
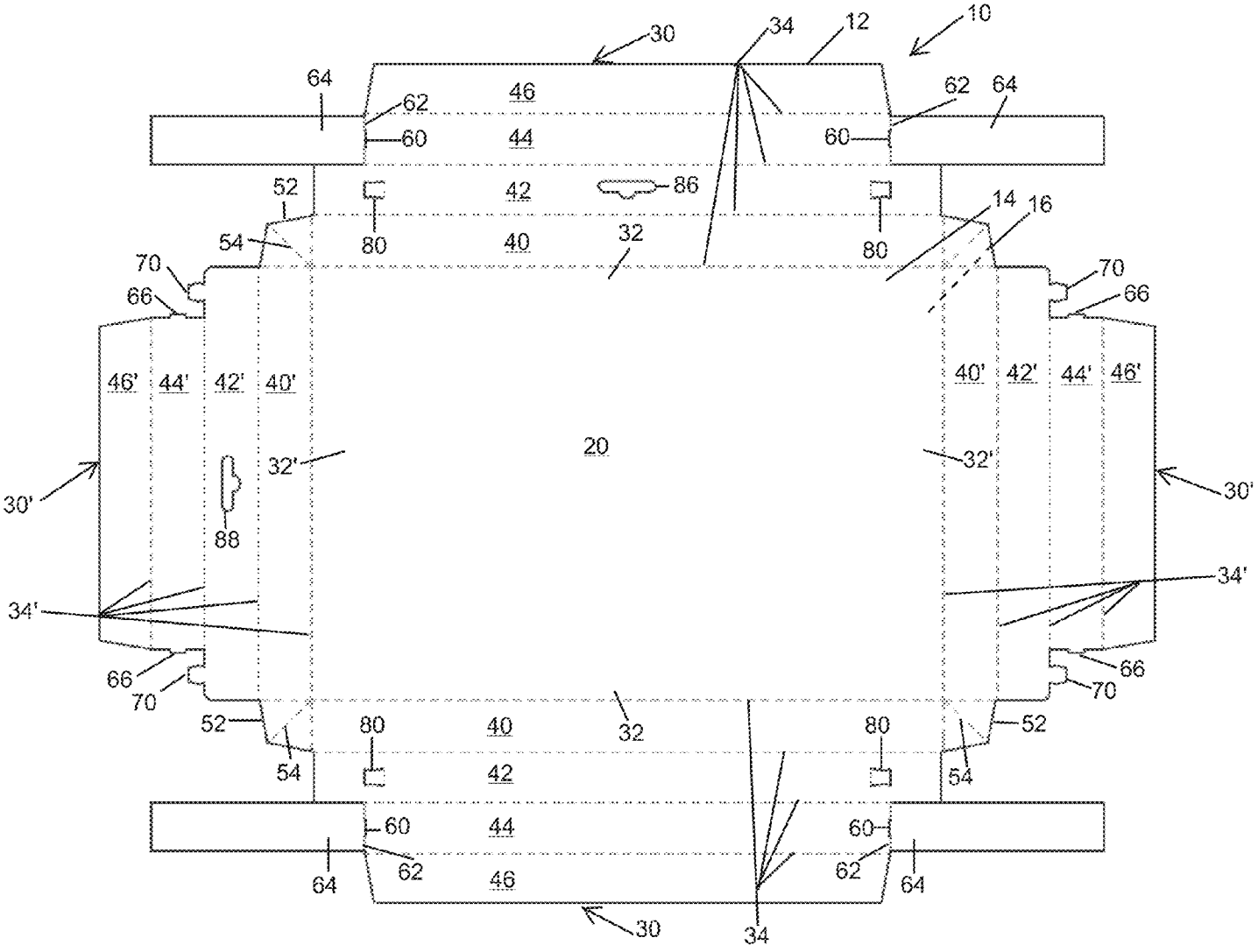
FIG. 1 is a blank of foldable sheet material for forming a picture frame with picture according to an embodiment of the present application.

FIG. 1 is a blank of foldable sheet material for forming a picture frame with picture according to an embodiment of the present application. As used herein, the term "picture" includes, but is not limited to, photograph, painting, drawing, portrait, image of someone or something printed, painted, drawn, or otherwise rendered on a surface.

The blank 10 includes a blank body 12 having a front surface 14 and a rear surface 16. A central rectangular portion 20 may be provided at a central portion of the blank body 12 and adapted to form thereon on the front surface 14 thereof a picture 18. The blank body 10 may be made of paperboard, or any other suitable material.

The blank 10 may include two opposite first wing portions 30, 30 and two opposite second wing portions 30', 30'. The two opposite first wing portions 30, 30 may extend from two opposite first margins 32, 32 of the central rectangular portion 20 respectively. The two opposite second wing portions 30', 30' may extend from two opposite second margins 32', 32' of the central rectangular portion 20 respectively. In the present embodiment, the two opposite first wing portions 30, 30 can be formed on the two longer sides of the central rectangular portion 20, and the two opposite second wing portions 30', 30' can be formed on the two shorter sides of the central rectangular portion 20. It is understood that the central rectangular portion 20 may be rectangular or square in shape.

Each of the first and second wing portions 30, 30' may include four parallel fold lines 34, 34' parallel with respect to the margin from which the wing portion extends, and defining an elongate frame-simulation panel 40, 40', a first elongate lock panel 42, 42', a second elongate lock panel 44, 44' and an elongate end panel 46, 46' in an order from the margin 32, 32'. Each elongate frame-simulation panel 40, 40' may be printed thereon with a printing simulating a frame surface of a conventional photo frame. As used herein, a "conventional photo frame" means a photo frame without a photo.

The four wing portions 30, 30' can be foldable rearwards about the fold lines 34, 34' to a folded position where the four end panels 46, 46' rest on the four margins 32, 32' of the central rectangular portion 20 at the rear surface 16 thereof respectively, thereby forming four rectangular tubular frame sections 50, 50' extending along the four margins 32, 32' of the central rectangular portion 20 at the rear surface 16 thereof.

Twelve locking mechanisms 1-12 may be provided to hold and lock the four rectangular tubular frame sections 50, 50' in the folded position.

Lock Mechanisms 1-4

The blank 10 may include an elongate panel extension 64 extending from each opposite end of each second elongate lock panels 44 of the two opposite first wing portions 30, 30. The elongate panel extension 64 may be flippable about a transverse fold line 62 formed between the elongate panel extension 64 and the opposite end of the second elongate lock panel 44 of the two opposite first wing portions 30, 30. A slit 60 may be formed along each transverse fold line 62 at a middle portion thereof. The blank 10 may include a tab 66 formed at each opposite end of each second elongate lock panel 44' of the two opposite second wing portions 30', 30'. The tab 66 may be rectangular in shape and may have two tapering sides.

After the two opposite first wing portions 30, 30 are folded into the folded position, the four elongate panel extensions 64 can be flipped 90 degrees about the transverse fold lines 62 towards the two opposite second margins 32', 32' such that the elongate panel extensions 64 can be held within the two rectangular tubular frame sections 50', 50' formed after the two opposite second wing portions 30', 30' are folded into the folded position. The four tabs 66 can be inserted into and engaged with the four slits 60 respectively at four corners of the picture frame (lock mechanisms 1-4), thereby locking the four tubular frame sections 50, 50' in the folded position.

Lock Mechanisms 5-8

The blank 10 may further include a flap 70 formed on a side edge of each opposite end portion of each first elongate lock panel 42' of the two opposite second wing portions 30', 30'. The side edge may be contiguous with and perpendicular to the opposite end of the second elongate lock panel 44' of the two opposite second wing portions 30', 30' on which the tab 66 is formed.

The blank 10 may also include a shaped slit 80 formed on each opposite end portion of each first elongate lock panel 42 of the two opposite first wing portions 30, 30. Each shaped slit 80 may include a transverse slit 81 and two longitudinal slits 82 extending from two opposite ends of the transverse slit 81 respectively towards a central portion of the first elongate lock panel 42. Each shaped slit 80 defines a temporarily covered aperture 83 and a cover 87.

The four flaps 70 can be disposed over the four temporarily covered apertures 83 respectively after the four wing portions 30, 30' are folded into the folded position. The four flaps 70 can be flippable through the four temporarily covered apertures 83 and engageable with the four apertures 83 respectively, thereby locking the four rectangular tubular frame sections 50, 50' in the folded position. Detailed structure of the flaps 70 and the temporarily covered apertures 83 will be described later.

The blank 10 may further include a corner panel 52 formed at each corner of the central rectangular portion 20 between adjacent ends of the elongate frame-simulation panels 40, 40' of the four wing portions 30, 30'. Each corner panel 52 may be formed with a diagonal fold line 54, whereby each corner panel 52 can be foldable inwards about the diagonal fold line 54 when the four wing portions 30, 30' are folded into the folded position.

A first opening 86 may be formed on one of the two first elongate lock panels 42, 42 of the two opposite first wing portions 30, 30, and a second opening 88 may be formed on one of the two first elongate lock panels 42', 42' of the two opposite second wing portions 30', 30' to facilitate hanging of the picture frame with picture on a wall, a door, etc.

FIG. 1.1 is a blank of foldable sheet material for forming into a first embodiment of a one-piece picture frame. The four shaded panels are the four elongate frame-simulation panels 40, 40' which may be printed thereon, at the same time of printing the picture 18, with a printing simulating a surface of a conventional photo frame, such as a conventional wooden photo frame. The four arrows show a picture area on the front surface 14 of the blank 10.

FIG. 1.1.1 is a folded picture frame with picture formed from the blank shown in FIG. 1.1. After the four wing portions 30, 30' are folded into the folded position, the four printed elongate frame-simulation panels 40, 40' become the four sides of the folded picture frame. The picture 18 may be formed on the entire picture area indicated by the four arrows, or just a portion of the picture area.

FIG. 1.2 is a blank of foldable sheet material for forming into a second embodiment of a one-piece picture frame. The shaded areas are the four elongate frame-simulation panels 40, 40' and the four margins 32, 32' which may be printed thereon, at the same time of printing the picture 18, with frame printings simulating the surfaces of a conventional photo frame, such as a conventional wooden photo frame. The four arrows show a picture area on the front surface 14 of the blank 10.

FIG. 1.2.1 is a folded picture frame with picture formed from the blank shown in FIG. 1.2. After the four wing portions 30, 30' are folded into the folded position, the four printed elongate frame-simulation panels 40, 40' become the four sides of the folded picture frame, and the four printed margins 32, 32' become four front surfaces of the folded picture frame. The four printed elongate frame-simulation panels 40, 40' and the four printed margins 32, 32' simulate a conventional three-dimensional photo frame. The picture 18 may be formed on the entire picture area, or just a portion of the picture area indicated by the four arrows.

In addition, a first rectangular border line 41 may be printed on the front surface 14 along a rectangular inner boundary of the four margins 32, 32', and a second rectangular border line 43 may be printed on the front surface 14 along a rectangular outer periphery of the picture 18 and spaced inwardly apart from the first rectangular border line 41 to thereby simulate the conventional photo frame with a picture mounted thereon.

Figure 2:
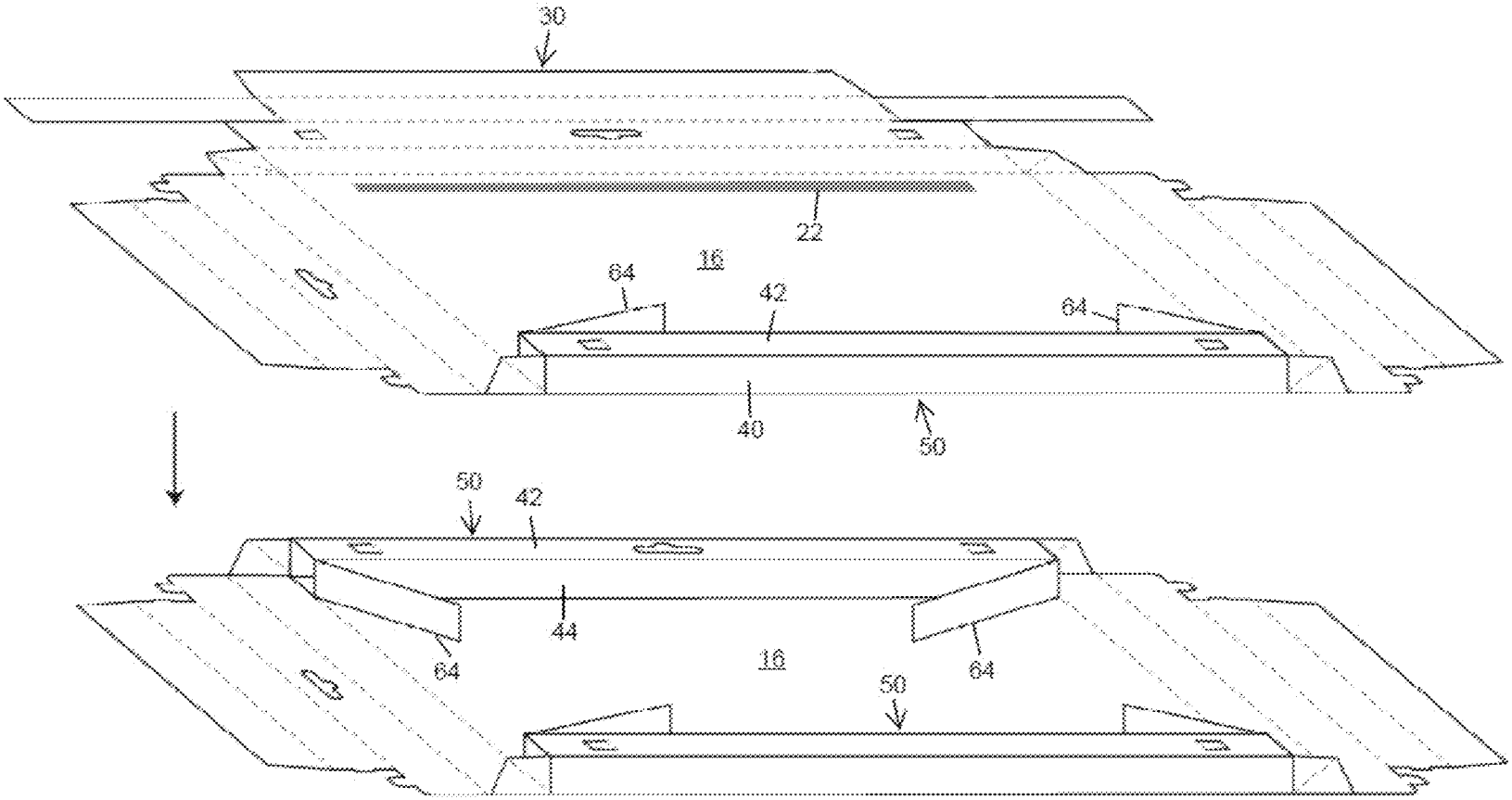
FIG. 2 shows the folding of the two long frame portions of the picture frame.

FIG. 2 shows the folding of the two opposite first wing portions 30, 30 of the picture frame. First of all, the two opposite first wing portions 30, 30 can be folded rearwards. The direction of folding of one of the two first wing portions 30, 30 is shown by an arrow. Two adhesive tapes 22 may be provided respectively along the two opposite first margins 32, 32 of the central rectangular portion 20 at the rear surface 16 thereof. When the two opposite first wing portions 30, 30 are folded into the rectangular tubular frame sections 50, 50, then the two elongate end panels 46, 46 can be adhered onto the rear surface 16 of the central rectangular portion 20 by the adhesive tapes 22. Glue or other suitable adhesive means may be used instead of the adhesive tapes 22.

FIG. 2.1A-B shows the folding the picture frame into a flat form for packaging. The four elongate panel extensions 64 can be folded inwards, as shown by the four arrows in FIG. 2.1A, and the two opposite first wing portions 30, 30 can be folded rearwards into the two opposite rectangular tubular frame sections 50, 50 which may then be pressed inwards, as shown by the other two arrows in FIG. 2.1A, into a collapsed and flat form as shown in FIG. 2.1B. The other two opposite second wing portions 30', 30' can be folded rearwards about the two innermost fold lines 34, as shown by the two arrows in FIG. 2.1B.

FIG. 2.2A-B shows the folded picture frame of FIG. 2.1 and a separate backing card 90. Details of the backing card 90 will be described later. The backing card 90 can be placed on the back side of the folded picture frame, as shown by the arrows in FIG. 2.2A. FIG. 2.2B shows the front side of the folded picture frame. The picture area is indicated by the four arrows. The picture frame and the backing card are then in a flat form ready for packaging.

Figure 3:
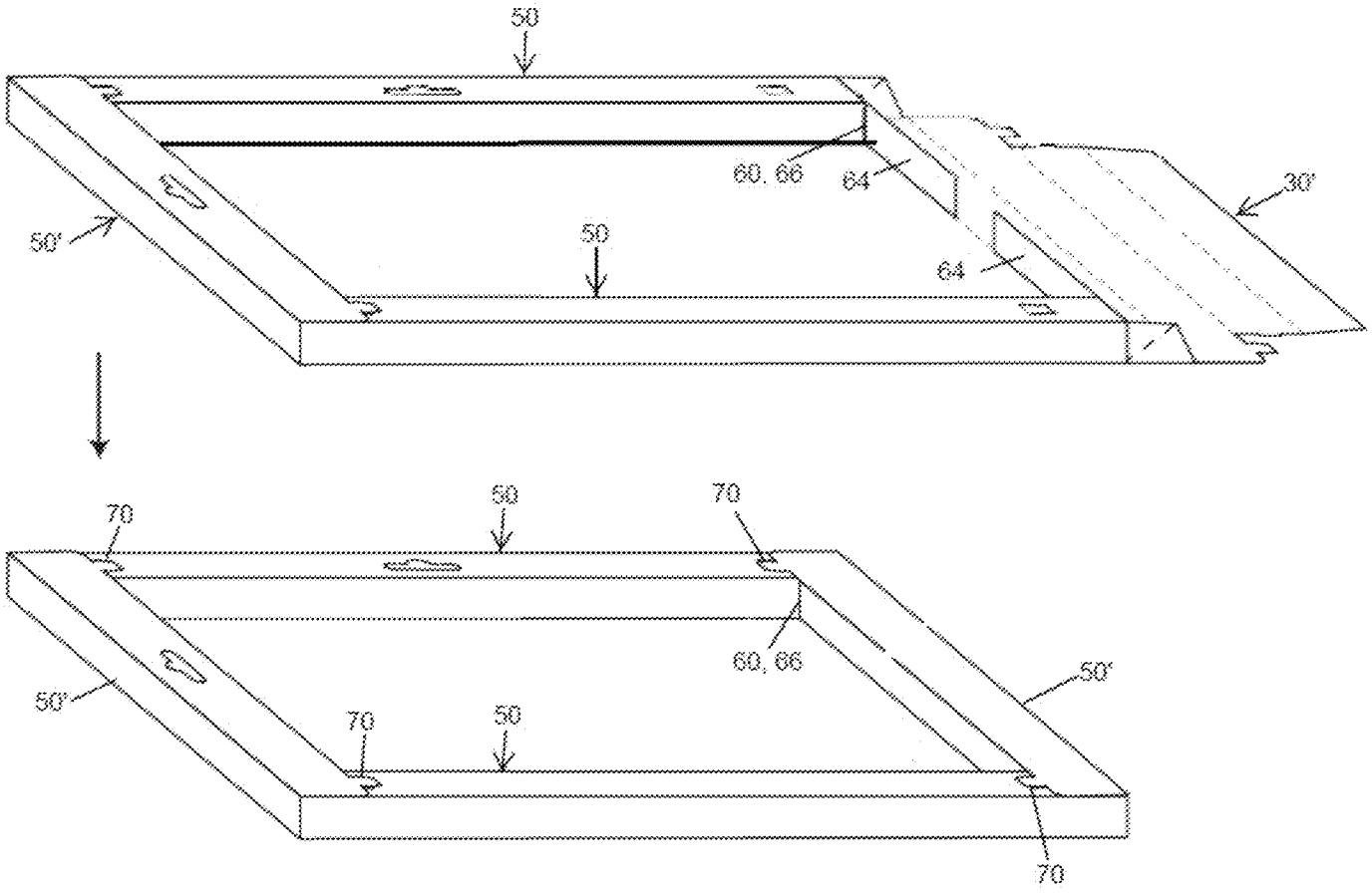
FIG. 3 shows the folding of the two short frame portions of the picture frame, and the locking mechanisms 1-4.

FIG. 3 shows the folding of the two opposite second wing portions 30', 30' of the picture frame. When the packed picture frame with picture is unpacked, the two collapsed opposite rectangular tubular frame sections 50, 50 can be returned to their rectangular tubular position. The four elongate panel extensions 64 can be flipped 90 degrees about the transverse fold lines 62 towards the two opposite second margins 32', 32' such that the four elongate panel extensions 64 can be held within the two rectangular tubular frame sections 50', 50' formed after the two opposite second wing portions 30', 30' are folded into the folded position, as shown by the arrows. The four tabs 66 can be inserted into and engaged with the four slits 60 respectively at four corners of the picture frame, thereby holding the four tubular frame sections 50, 50' in the folded position.

According to mechanics of structure, these four elongate panel extensions 64 can effectively prevent unfolding of the two opposite rectangular tubular frame sections 50', 50' formed after the two opposite second wing portions 30', 30' are folded into the folded position, thereby securely holding the four rectangular tubular frame sections 50, 50' in the folded position.

Figure 4:
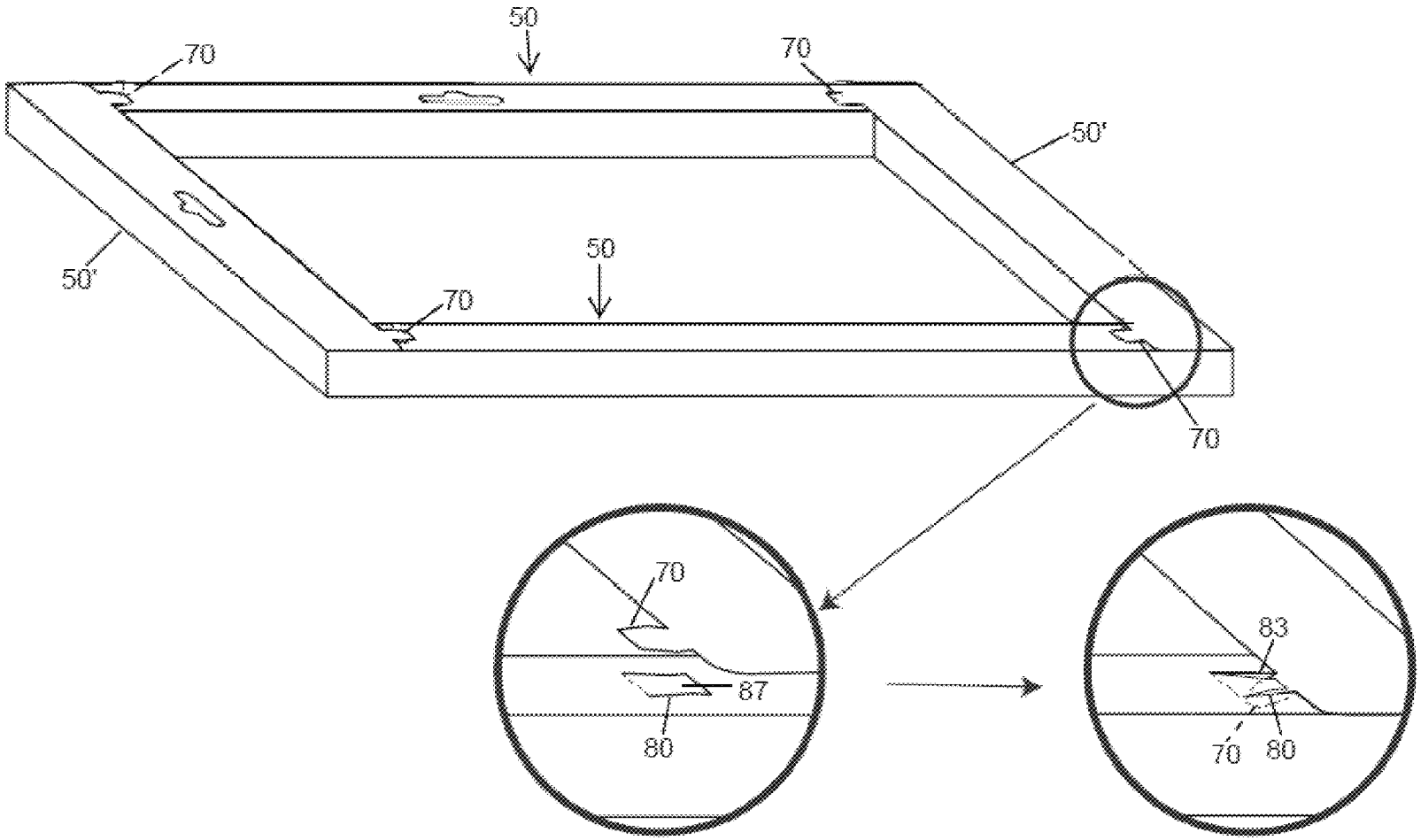
FIG. 4 shows the locking mechanisms 5-8 of the picture frame.

FIG. 4 shows the locking mechanisms 5-8 of the picture frame with picture. The four flaps 70 are disposed over the four temporarily covered apertures 83 respectively after the four wing portions 30, 30' are folded into the folded position, and the four flaps 70 are flippable through the temporarily covered apertures 83 and retainable by the four apertures 83 respectively, thereby locking the four tubular frame sections 50, 50' in the folded position.

FIG. 4.1 is an enlarged view of the locking mechanisms 1 and 5 of the picture frame. Locking mechanisms 1 and 5 (so as locking mechanisms 2 and 6, locking mechanisms 3 and 7, locking mechanisms 4 and 8) can work together to provide a very tight locking strength to the panels of the rectangular tubular frame sections 50, 50'. When the pre-glued area 22 is glued and the panels of the rectangular tubular frame sections 50, 50' are in the folded position, two locking points 73, 73 of the flap 70 and two locking points 67, 67 of the tab 66 are activated. The panels of the rectangular tubular frame sections 50, 50' can be locked tightly and cannot be pulled out in any direction, including horizontal and vertical directions.

Locking Mechanisms 9-12

Figure 5:
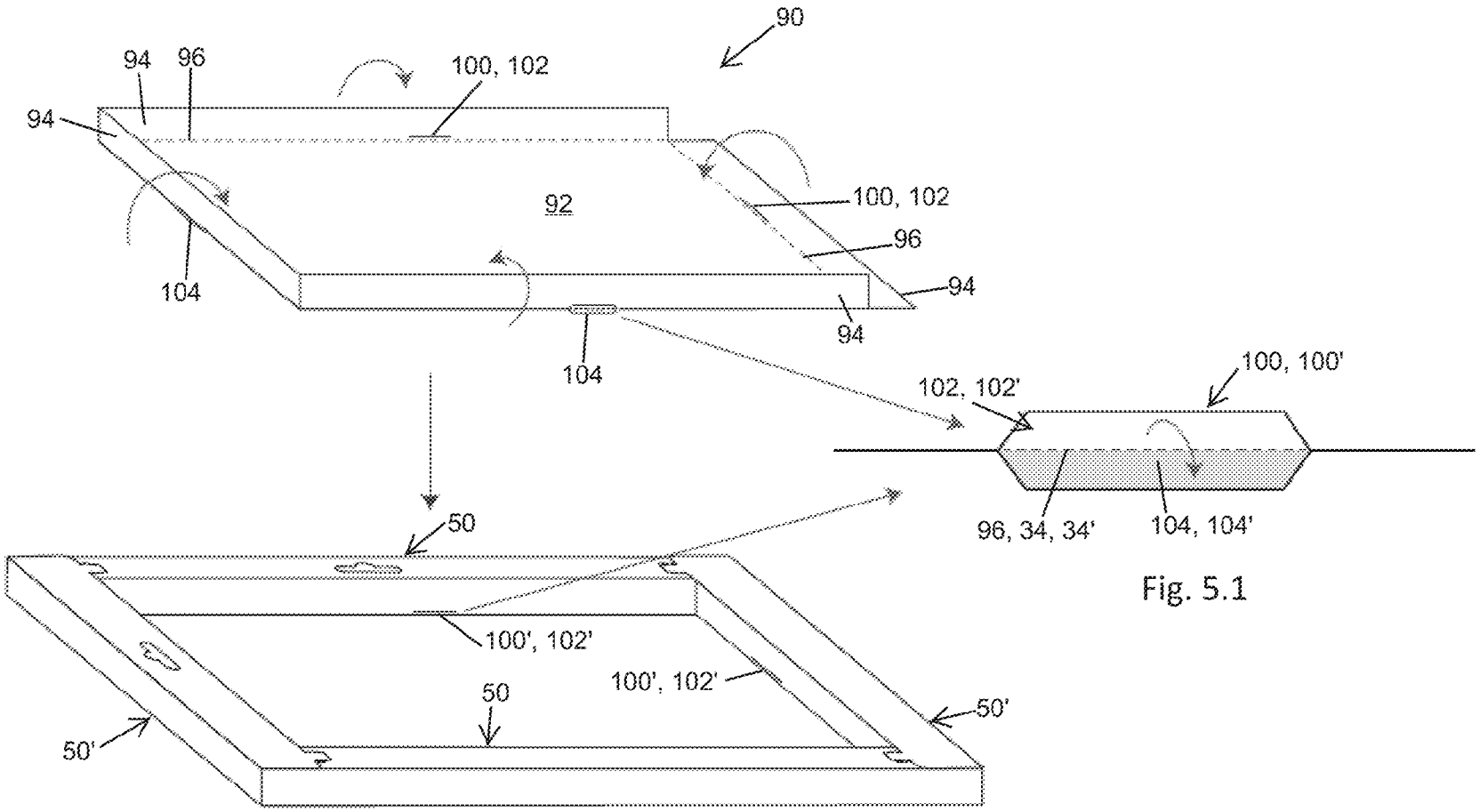
FIG. 5 shows the folding of the backing card and the locking mechanisms 9-12.

FIG. 5 shows the folding of the backing card and the locking mechanisms 9-12. The picture frame with picture of the present application may further include a separate backing card 90. The backing card 90 may include a rectangular panel 92, and four side panels 94 formed along four side edges of the rectangular panel 92 respectively such that after the four side panels 94 are folded 90 degrees towards one side of the rectangular panel 92 about four backing card fold lines 96 formed along the four side edges of the rectangular panel 92 respectively, the folded backing card 90 can be insertable into a rectangular space defined by the four rectangular tubular frame sections 50, 50' in the folded position such that the rectangular panel 92 rests on the rear surface 16 of the central rectangular portion 20 and the four side panels 94 snugly abut against the second elongate lock panels 44, 44' of the four tubular frame sections 50, 50' respectively.

FIG. 5.1 is an enlarged view of the locking mechanisms 9-12 of the backing card 90. The backing card 90 may further include four square bracket-shaped slits 100 each having a shape of a square bracket "[" formed on each backing card fold line 96, and when the backing card fold line 96 is folded, a slot 102 and a projection 104 having a shape of a square bracket "[" can be formed.

A corresponding square bracket-shaped slit 100' may further be formed on each fold line 34, 34' between the second elongate lock panel 44, 44' and the elongate end panel 46 of each of the four wing portions 30, 30', and when the fold line 34, 34' is folded, a slot 102' and a projection 104' having a shape of a square bracket "[" can be formed.

The four projections 104 formed on the backing card 90 are insertable into the four corresponding slots 102' formed on the four rectangular tubular frame sections 50, 50' after the four wing portions 30, 30' are folded into the folded position, thereby locking the four rectangular tubular frame sections 50, 50' in the folded position.

Figure 6:
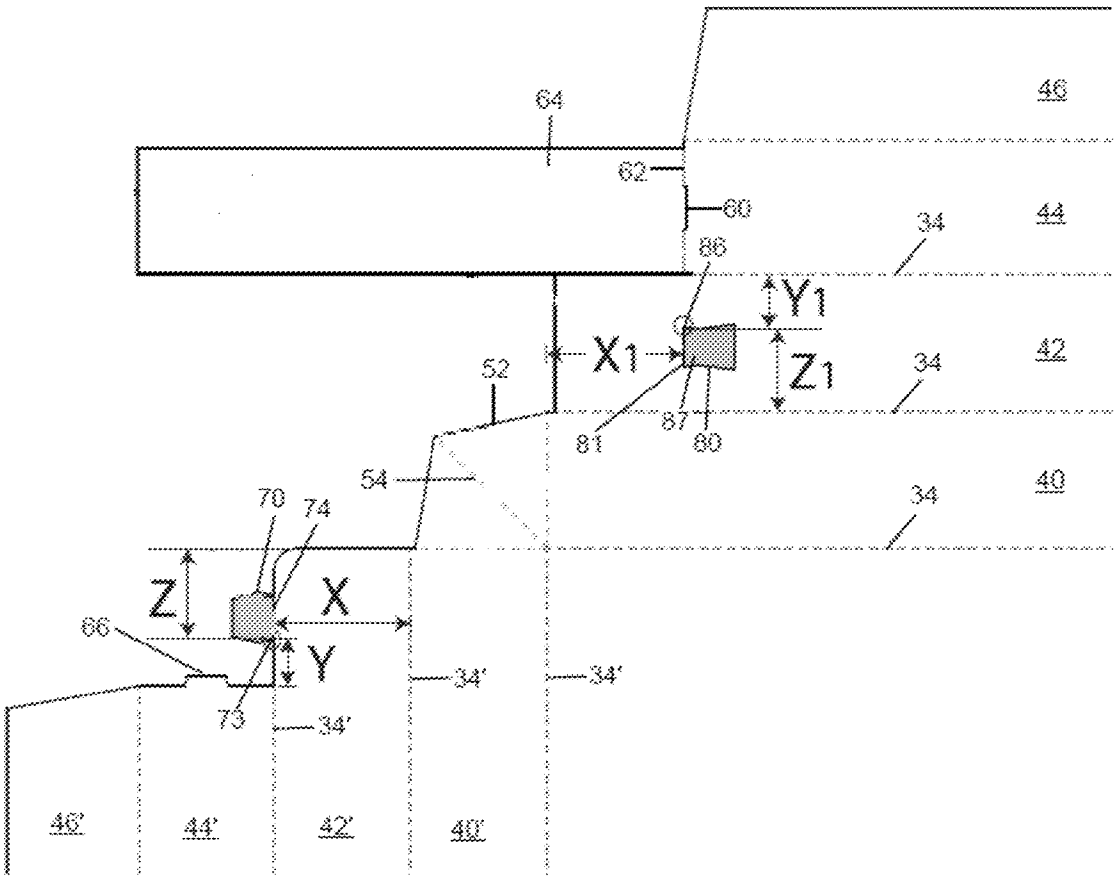
FIG. 6 is an enlarged view of the locking mechanisms 1 and 5.

FIG. 6 is an enlarged view of the locking mechanisms 1 and 5, and FIG. 6.1 shows the detailed structure of the flaps 70 and the apertures 83, which are the locking mechanisms 5-8. Each flap 70 may have two opposite sides formed with two protruding portions 71 respectively, and defining two opposite undercuts 72 with two locking points 73 disposed at two opposite ends of a base 74 of the flap 70 respectively. Each aperture 83 may have two opposite sides formed with two oppositely facing protruding portions 84 respectively, and defining two corresponding opposite undercuts 85 with two corresponding locking points 86 disposed at two opposite ends of the transverse slit 81.

The flap 70 at the two protruding portions 71 has a width longer than that of the aperture 83 at the two oppositely facing protruding portions 84, whereby when the flap 70 is flipped through the temporarily closed aperture 83, the two protruding portions 71 of the flap 70 are retainable under the two oppositely facing protruding portions 84 of the aperture 83 respectively, and the two opposite locking points 73 of the two opposite undercuts 72 of the flap 70 are engageable with the two corresponding locking points 86 of the two corresponding opposite undercuts 85 of the aperture 83 respectively, thereby locking the four rectangular tubular frame sections 50, 50' in the folded position.

According to mechanics of structure, these locking points 73, 86 and opposite undercuts 72, 85 can effectively prevent unfolding of the two opposite rectangular tubular frame sections 50', 50' formed after the two opposite second wing portions 30', 30' are folded into the folded position, thereby securely locking the four rectangular tubular frame sections 50, 50' in the folded position.

As shown in FIG. 6, the distance X between the base 74 of the flap 70 and the fold line 34' between the elongate frame-simulation panel 40' and the first elongate lock panel 42' of the second wing portion 30' is equal to the distance X1 between the transverse slit 81 and the innermost fold line 34' of the second wing portion 30'. The distance Y between one of the two opposite locking points 73, 73 of the flap 70 and the end of the second elongate lock panel 44' of the second wing portion 30' is equal to the distance Y1 between one of the two opposite locking points 86, 86 of the aperture 83 and the fold line 34 between the first and second elongate lock panels 42, 44 of the first wing portion 30. The distance Z between that same one of the two opposite locking points 73, 73 of the flap 70 and the end of the first elongate lock panel 42' of the second wing portion 30' is equal to the distance Z1 between that same one of the two opposite locking points 86, 86 of the aperture 83 and the fold line 34 between the elongate frame-simulation panel 40 and the first elongate lock panel 42 of the first wing portion 30.

Although the picture 18 can be printed on the front surface 14 of the blank 10 at the central rectangular portion 20 thereof at the time of forming the blank 10, it is appreciated that the central rectangular portion 20 can be blank, and the picture 18 can be subsequently printed or painted on the central rectangular portion 20. For example, a printer, such as an ink jet/laser jet printer can be used to subsequently print the picture 18 on the central rectangular portion 20. This can satisfy the need of a "print on demand" picture frame. Alternatively, the picture, such as a painting or drawing, can be subsequently painted or drawn on the central rectangular portion 20 by paint brushes or any other painting instruments.

Figure 7:
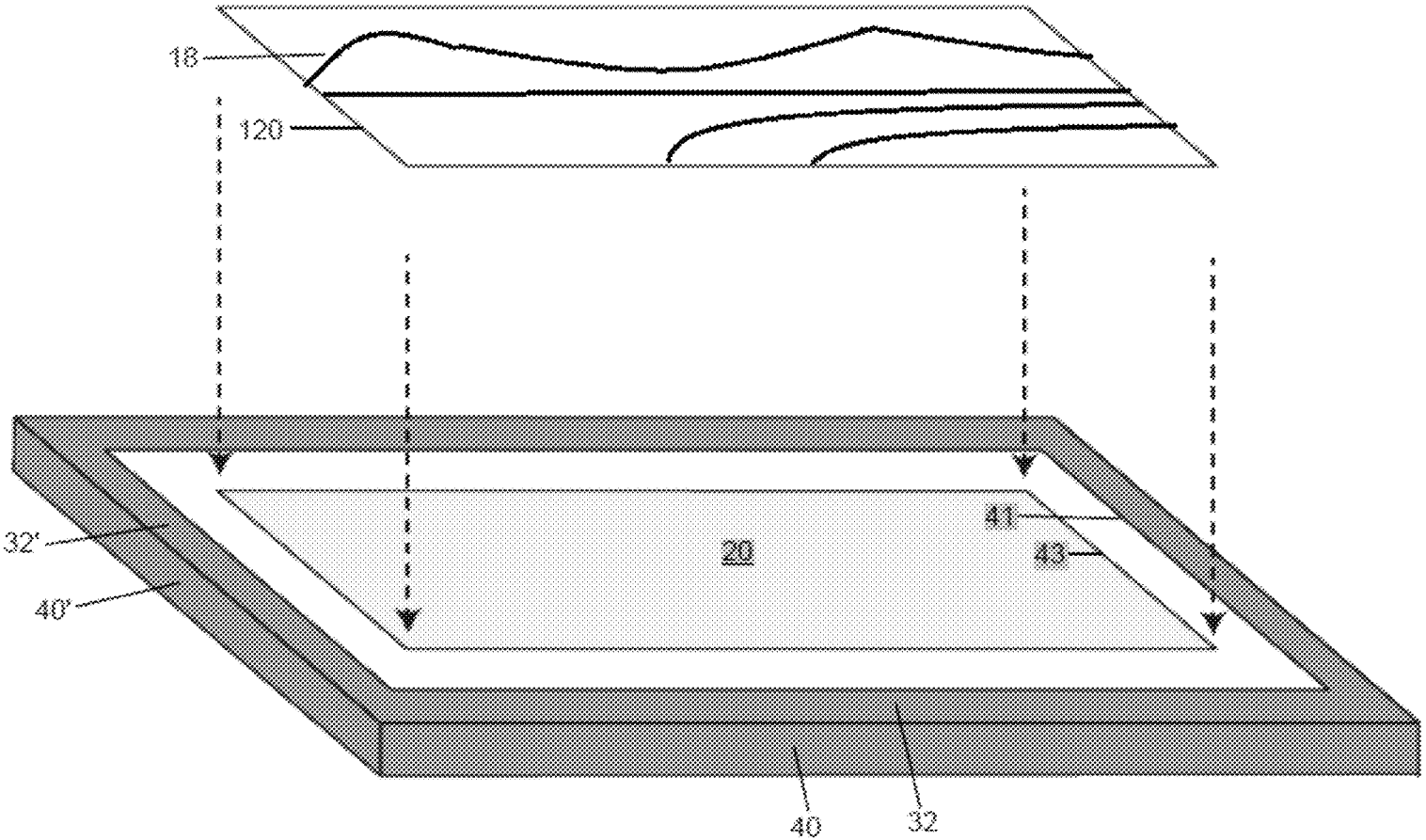
FIG. 7 shows a picture printed or painted on a sheet of material which can be adhered on the front surface of the picture frame according to another embodiment of the present application.

FIG. 7 shows the picture 18 printed or painted on a sheet of material 120, which is then adhered on the front surface 14 of the picture frame according to another embodiment of the present application. In this embodiment, the picture 18 can be printed or painted on the sheet of material 120, which may be in the form of a sheet of paper or a canvas, etc. For example, the picture 18 can be printed on a sheet of paper, and the paper can then be adhered on the central rectangular portion 20 by glue or any other suitable adhesive means. Similarly, the picture 18, such as a painting, can be painted on a canvas, and the canvas can then be adhered on the central rectangular portion 20 by glue or any other suitable adhesive means.

The blank for forming the one-piece picture frame in the present application may be made of paperboard. Paperboard has the characteristics of being printable, foldable and compressable. Using die-cutting technology, fold lines and locking features can be formed on a paperboard by die-cutting to produce a foldable picture frame. The picture frame so formed has an outer appearance resembling a convention photo frame mounted thereon with a photo/picture. The picture frame with picture of the present application is made from a single piece of paperboard. The paperboard can be manually folded once to form a 3-dimensional picture frame with picture.

Since the picture frames of the present application are made from paperboards, these paperboards can be re-cycled and it therefore environmental-friendly. The production cost of these picture frames with pictures of the present application is much lower than that of a conventional photo frame with separately mounted photo/picture.

Furthermore, the picture frame with picture of the present application is suitable for both small and large amount of printing. Offset printing can be used for large amount of printing, and inkjet printing can be used for small amount of printing. The picture content, the color of the frame as well as its pattern can be feasibly matched and finished in one single printing. After the paperboard is die-cut by a machine, and manually folded and locked, a picture frame with picture is produced.

The picture frame with picture of the present application can be packed into a flat package, which is small in size, light in weight, easy to transport, and relatively cheap in mailing.

The picture frame with picture of the present application may be provided with two adhesive portions and twelve locking points. A user can easily fold and lock the picture frame without the use of additional adhesive means to fix the picture frame. The folding and locking methods are easy to cope with. The final product has aesthetic effect and a strong structure.

The additional backing card can enhance protection during transportation. Furthermore, when the additional backing card is folded up and inserted into the space at the back of the picture frame, it can enhance the structure of the picture frame.

Although a picture with foldable frame has been shown and described, it is understood that any printed card or sheet with foldable frame can also be produced.

For example, FIGS. 8.1-8.2 show two embodiments of a blank 10 for forming into a greeting card with foldable frame. The greeting card is a printed card or sheet which may be printed thereon with a print 18' such as a greeting message or description. FIGS. 8.3-8.4 show two embodiments of a blank 10 for forming into a coloring sheet with foldable frame. The coloring sheet is a printed sheet which may be printed thereon with a print 18" such as a line drawing or illustration outline 18" for adding colors using crayons or colored pencils. The detailed structure and method of folding of the blank 10 in FIGS. 8.1-8.4 are the same as those described hereinbefore, and will not be repeated here.

Figure 10:
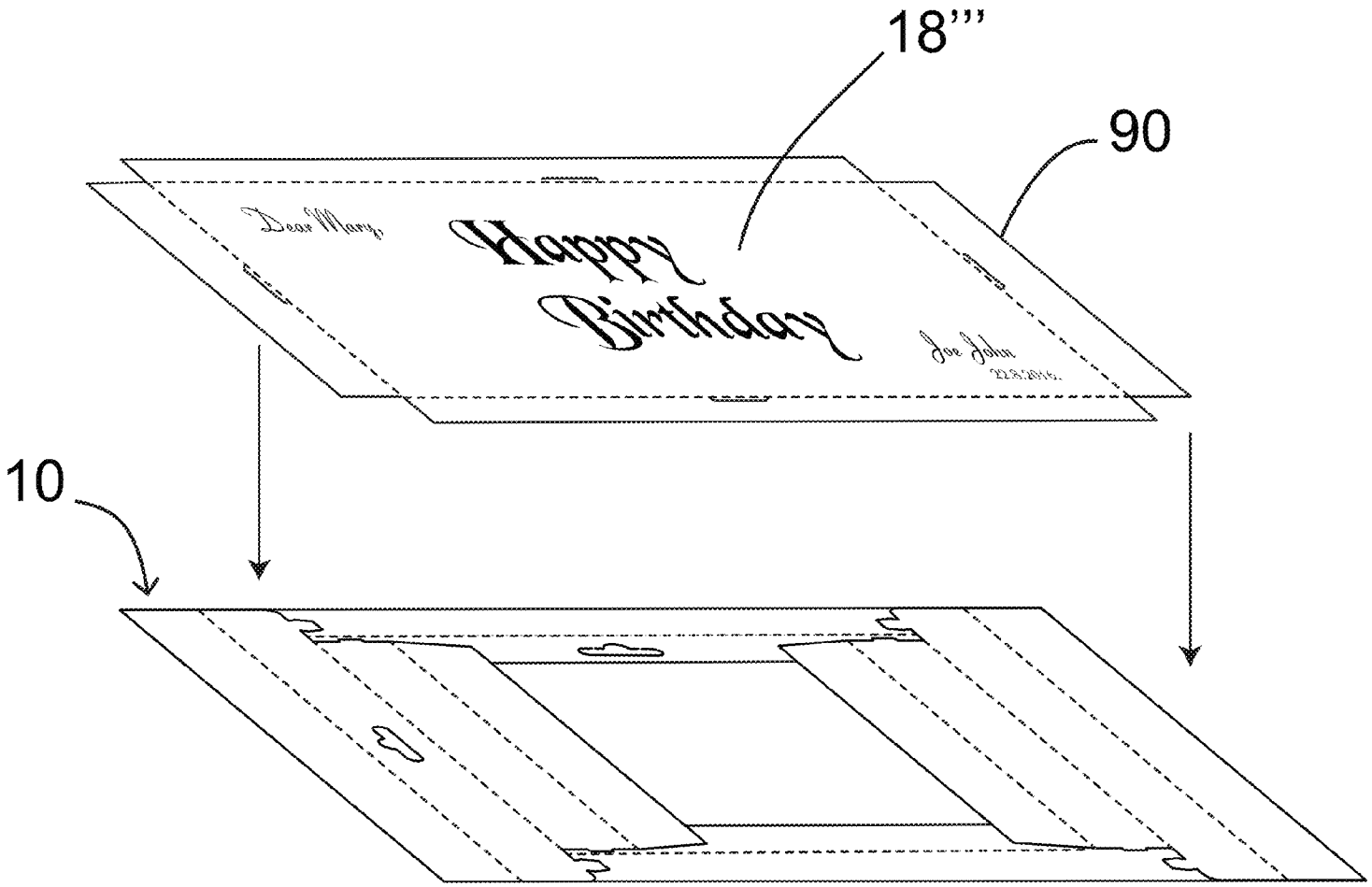
FIG. 10 shows the addition of a backing card to the folded frame, wherein the backing card is printed or written thereon with a greeting description.

FIGS. 9.1 and 9.2 show the steps of folding the foldable frame into a flat form. FIG. 10 shows the addition of a backing card 90 which may be provided with a further greeting message or description 18'" printed or written on an outwardly facing surface thereof in a manner similar to the inner page of a traditional greeting card; and FIGS. 11.1 and 11.2 show the front and rear perspective views respectively of a finished product in a flat form for delivery, as described hereinbefore.

FIGS. 12.1-12.2 are two embodiments of the greeting card with folded frame formed from the blanks shown in FIGS. 8.1-8.2 respectively; and FIGS. 12.3-12.4 are two embodiments of the coloring sheet with folded frames formed from the blanks shown in FIGS. 8.3-8.4 respectively.

FIGS. 13.1 and 13.2 are front and rear perspective views respectively of the folded frame with the greeting message 18' printed on the front and the further greeting message or description 18'" printed or written on the outwardly facing surface of the folded backing card 90.

While the printed sheet with foldable frame has been shown and described with particular references to a number of preferred embodiments thereof, it should be noted that various other changes or modifications may be made without departing from the scope of the appended claims.

What is claimed is:

1. A blank of foldable sheet material for forming a printed sheet with foldable frame, the blank comprising:

(a) a blank body having a front surface and a rear surface;

(b) a central rectangular portion provided at a central portion of the blank body and adapted to form thereon on the front surface thereof a print;

(c) two opposite first wing portions extending from two opposite first margins of the central rectangular portion respectively; and (d) two opposite second wing portions extending from two opposite second margins of the central rectangular portion respectively;

(e) wherein each of the first and second wing portions comprises four parallel fold lines parallel with respect to the margin from which the wing portion extends, and defines an elongate frame-simulation panel, a first elongate lock panel, a second elongate lock panel and an elongate end panel in an order from the margin; each elongate frame-simulation panel being printed thereon with a frame-simulating printing simulating a frame surface of a conventional photo frame;

(f) wherein the four wing portions are foldable rearwards about the fold lines to a folded position where the four end panels rest on the four margins of the central rectangular portion at the rear surface thereof respectively, thereby forming four rectangular tubular frame sections extending along the four margins of the central rectangular portion at the rear surface thereof, wherein the blank further comprises:

(g) an elongate panel extension extending from each opposite end of each second elongate lock panels of the two opposite first wing portions, and flippable about a transverse fold line formed between the elongate panel extension and the opposite end of the second elongate lock panel of the two opposite first wing portions;

(h) a slit formed along each transverse fold line at a middle portion thereof; and (i) a tab formed at each opposite end of each second elongate lock panel of the two opposite second wing portions;

(j) wherein after the two opposite first wing portions are folded into the folded position, the four elongate panel extensions are flippable 90 degrees about the transverse fold lines towards the two opposite second margins such that the elongate panel extensions are held within the two tubular frame sections formed after the two opposite second wing portions are folded into the folded position, and wherein the four tabs are inserted into and engaged with the four slits respectively at four corners of the folded frame, thereby locking the four tubular frame sections in the folded position.

2. The blank as claimed in claim 1, further comprising:

(a) a flap formed on a side edge of each opposite end portion of each first elongate lock panel of the two opposite second wing portions, and the side edge being contiguous with and perpendicular to the opposite end of the second elongate lock panel of the two opposite second wing portions on which the tab is formed; and (b) a shaped slit formed on each opposite end portion of each first elongate lock panel of the two opposite first wing portions, each shaped slit comprising a transverse slit and two longitudinal slits extending from two opposite ends of the transverse slit respectively towards a central portion of the first elongate lock panel, and each shaped slit defining a temporarily covered aperture and a cover;

(c) wherein the four flaps are disposed over the four temporarily covered apertures respectively after the four wing portions are folded into the folded position, and the four flaps are flippable through the temporarily covered apertures and engageable with the four apertures respectively, thereby locking the four rectangular tubular frame sections in the folded position.

3. The blank as claimed in claim 2, wherein each flap has two opposite sides formed with two protruding portions respectively and defining two opposite undercuts with two locking points disposed at two opposite ends of a base of the flap respectively, and each aperture has two opposite sides formed with two oppositely facing protruding portions respectively, and defining two corresponding opposite undercuts with two corresponding locking points disposed at two opposite ends of the transverse slit; and wherein the flap at the two protruding portions has a width longer than that of the aperture at the two oppositely facing protruding portions, whereby when the flap is flipped through the temporarily closed aperture, the two protruding portions of the flap are retainable under the two oppositely facing protruding portions of the aperture respectively, and the two opposite locking points of two opposite undercuts of the flap are engageable with the two corresponding locking points of the two corresponding opposite undercuts of the aperture respectively, thereby locking the four tubular frame sections in the folded position.

4. A printed sheet with foldable frame formed from a blank of foldable sheet material as claimed in claim 2.

5. The printed sheet with foldable frame as claimed in claim 4, further comprising a separate backing card comprising a rectangular panel, and four side panels formed along four side edges of the rectangular panel respectively such that after the four side panels are folded 90 degrees towards one side of the rectangular panel about four backing card fold lines formed along the four side edges of the rectangular panel respectively, the folded backing card is insertable into a rectangular space defined by the four rectangular tubular frame sections in the folded position such that the rectangular panel rests on the rear surface of the central rectangular portion and the four side panels snugly abut against the second elongate lock panels of the four rectangular tubular frame sections respectively.

6. The printed sheet with foldable frame as claimed in claim 5, further comprising four square bracket-shaped slits each having a shape of a square bracket "[" formed on each backing card fold line, and when the backing card fold line is folded, a slot and a projection having a shape of a square bracket "[" are formed;

wherein a corresponding square bracket-shaped slit is further formed on each fold line between the second elongate lock panel and the elongate end panel of each of the four wing portions, and when the fold line is folded, a slot and a projection having a shape of a square bracket "[" are formed;

whereby the four projections formed on the backing card are insertable into the four corresponding slots formed on the four rectangular tubular frame sections after the four wing portions are folded into the folded position, thereby locking the four rectangular tubular frame sections in the folded position.

7. The printed sheet with foldable frame as claimed in claim 5, wherein a greeting message is printed or written on an outwardly facing surface of the backing card.

8. The blank as claimed in claim 1, wherein the four margins of the central rectangular portion at the front surface thereof are further printed thereon with the frame-simulating printing simulating the frame surface of the conventional photo frame, and the print is printed on the front surface within the four margins.

9. The blank as claimed in claim 8, further comprising a first rectangular border line printed on the front surface along a rectangular inner boundary of the four margins, and a second rectangular border line printed on the front surface along a rectangular outer periphery of the print and spaced inwardly apart from the first rectangular border line to thereby simulate the conventional photo frame.

10. The blank as claimed in claim 1, further comprising a corner panel formed at each corner of the central rectangular portion between adjacent ends of the elongate frame-simulation panels of the four wing portions, each corner panel being formed with a diagonal fold line whereby each corner panel is foldable inwards about the diagonal fold line when the four wing portions are folded into the folded position.

11. The blank as claimed in claim 1, wherein the two elongate end panels of the two opposite first wing portions are adhered to the rear surface of the central rectangular portion at the first margin thereof by glue or adhesive tapes.

12. The blank as claimed in claim 1, wherein a first opening is formed on one of the two first elongate lock panels of the two opposite first wing portions, and a second opening is formed on one of the two first elongate lock panels of the two opposite second wing portions to facilitate hanging of the folded frame on a wall.

13. The blank as claimed in claim 1, wherein the blank body is made of paperboard.

14. The blank as claimed in claim 1, wherein the print comprises a greeting message of a greeting card.

15. The blank as claimed in claim 1, wherein the print comprises an illustration outline of a coloring sheet.

16. A method for producing a printed sheet with foldable frame from a blank of foldable sheet material, the method comprising:

(a) forming a blank comprising:

a blank body having a front surface and a rear surface;

a central rectangular portion provided at a central portion of the blank body and adapted to form thereon on the front surface thereof a print;

two opposite first wing portions extending from two opposite first margins of the central rectangular portion respectively; and two opposite second wing portions extending from two opposite second margins of the central rectangular portion respectively;

wherein each of the first and second wing portions comprises four parallel fold lines parallel with respect to the margin from which the wing portion extends, and defining an elongate frame-simulation panel, a first elongate lock panel, a second elongate lock panel and an elongate end panel in an order from the margin; each frame-simulation panel being printed thereon with a frame-simulating printing simulating a frame surface of a conventional photo frame; and (b) folding the four wing portions rearwards about the fold lines to a folded position where the four end panels rest on the four margins of the central rectangular portion at the rear surface thereof respectively, thereby forming four rectangular tubular frame sections extending along the four margins of the central rectangular portion at the rear surface thereof, wherein the method further comprises:

(c) forming, at the same time of forming the blank, an elongate panel extension extending from each opposite end of each second elongate lock panels of the two opposite first wing portions, and flippable about a transverse fold line formed between the elongate panel extension and the opposite end of the second elongate lock panel of the two opposite first wing portions;

a slit formed along each transverse fold line at a middle portion thereof; and a tab formed at each opposite end of each second elongate lock panel of the two opposite second wing portions; and (d) flipping the four elongate panel extensions 90 degrees about the transverse fold lines towards the two opposite second margins after the two opposite first wing portions are folded into the folded position, such that the elongate panel extensions are held within the two tubular frame sections formed after the two opposite second wing portions are folded into the folded position, and wherein the four tabs are inserted into and engaged with the four slits respectively at four corners of the folded frame, thereby locking the four tubular frame sections in the folded position.

17. The method as claimed in claim 16, further comprising printing the print on the front surface of the blank body at the central rectangular portion thereof at the same time of printing the frame-simulating printing.

18. The method as claimed in claim 17, further comprising printing on the four margins of the central rectangular portion at the front surface thereof with the frame-simulating printing simulating the frame surface of the conventional photo frame at the same time of printing the print, and the print is printed on the front surface within the four margins.

19. The method as claimed in claim 18, further comprising printing, at the same time of printing the frame-simulating printing, a first rectangular border line on the front surface along a rectangular inner boundary of the four margins, and a second rectangular border line on the front surface along a rectangular outer periphery of the print and spaced inwardly apart from the first rectangular border line to thereby simulate the conventional photo frame.

20. The method as claimed in claim 16, further comprising:

(a) forming, at the same time of forming the blank, a flap on a side edge of each opposite end portion of each first elongate lock panel of the two opposite second wing portions, and the side edge being contiguous with and perpendicular to the opposite end of the second elongate lock panel of the two opposite second wing portions on which the tab is formed; and a shaped slit each being formed on each opposite end portion of each first elongate lock panel of the two opposite first wing portions, each shaped slit comprising a transverse slit and two longitudinal slits extending from two opposite ends of the transverse slit respectively towards a central portion of the first elongate lock panel, and each shaped slit defining a temporarily covered aperture and a cover, wherein the four flaps are disposed over the four temporarily covered apertures respectively after the four wing portions are folded into the folded position; and (b) flipping the four flaps through the temporarily covered apertures such that the four flaps are engageable with the four apertures respectively, thereby locking the four rectangular tubular frame sections in the folded position.

* * * * *